US006579139B1

(12) United States Patent
Mishima et al.

(10) Patent No.: US 6,579,139 B1
(45) **Date of Patent: *Jun. 17, 2003**

(54) FILM FORMATION METHOD, METHOD FOR FABRICATING ELECTRON EMITTING ELEMENT EMPLOYING THE SAME FILM, AND METHOD FOR MANUFACTURING IMAGE FORMING APPARATUS EMPLOYING THE SAME ELEMENT

(75) Inventors: Seiji Mishima, Zama (JP); Mitsutoshi Hasegawa, Yokohama (JP); Kazuhiro Sando, Atsugi (JP); Kazuya Shigeoka, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/248,101

(22) Filed: Feb. 11, 1999

(30) Foreign Application Priority Data

| | | |
|---|---|---|
| Feb. 13, 1998 | (JP) | 10-046335 |
| Dec. 28, 1998 | (JP) | 10-372126 |
| Feb. 8, 1999 | (JP) | 11-029930 |

(51) Int. Cl.[7] ..... H01J 9/02
(52) U.S. Cl. ..... 445/24; 427/10
(58) Field of Search ..... 445/24, 6, 51; 427/10

(56) References Cited

U.S. PATENT DOCUMENTS 5,066,883 A 11/1991 Yoshioka et al. ..... 313/309

FOREIGN PATENT DOCUMENTS

| | | |
|---|---|---|
| EP | 0 717 428 | 6/1996 |
| EP | 0 866 486 A2 | 9/1998 |
| JP | 01-031332 | 2/1989 |
| JP | 01-283749 | 11/1989 |
| JP | 02-056822 | 2/1990 |
| JP | 02-257552 | 10/1990 |
| JP | 7-95623 | 12/1990 |
| JP | 3-71690 | 3/1991 |
| JP | 4-67696 | 3/1992 |
| JP | 7-95623 | 10/1995 |
| JP | 8-86913 | 4/1996 |
| JP | 08-171850 | 7/1996 |
| JP | 9-106758 | 4/1997 |
| JP | 9-192864 | 7/1997 |
| JP | 9-213212 | 8/1997 |
| JP | 09-213212 | 8/1997 |
| JP | 9-277571 | 10/1997 |

OTHER PUBLICATIONS

Patent Abstracts of Japan, JP 09–213212, vol. 097, No. 012 (1997).

Dyke, W.P., et al., "Field Emission," Advances in Electronics and Electron Physics, New York: Academic Press, Inc. (1956), pp. 89–185.

Elinson, M.I., et al., "The Emission of Hot Electrons and the Field Emission of Electrons from Tin Oxide," Radio Engineering and Electronic Phys., No. 7 (1965), pp. 1290–1296.

(List continued on next page.)

*Primary Examiner*—Kenneth J. Ramsey
(74) *Attorney, Agent, or Firm*—Fitzpatrick, Cella Harper & Scinto

(57) ABSTRACT

Disclosed is a method, for forming a film locally on a substrate, which comprises the steps of detecting the state of the substrate employing the obtained result to calculate positional information concerning a plurality of locations at which the material for the film is to be provided to form the film, and providing the material for the film at the plurality of locations based on the positional information that is obtained for the plurality of locations.

53 Claims, 29 Drawing Sheets

OTHER PUBLICATIONS

Mead, C.A., "Operation of Tunnel–Emission Devices," Journal of Applied Physics, vol. 32, No. 4 (1961), pp. 646–652.

Dittmer, G., "Electrical Conduction and Electron Emission of Discontinuous Thin Films," Thin Solid Films, vol. 9 (1972), pp. 317–328.

Hartwell, M., et al., "Strong Electron Emission from Patterned Tin–Indium Oxide Thin Films," International Electron Devices Meeting (1975), pp. 519–521.

Spindt, C.A., et al., "Physical Properties of Thin–Film Field Emission Cathodes with Molybdenum Cones," Journal of Applied Physics, vol. 47, No. 12 (1976), pp. 5248–5263.

Araki, H., et al., "Electroforming and Electron Emission of Carbon Thin Films," Journal of the Vacuum Society of Japan, vol. 26, No. 1 (1983), pp. 22–29.

FIG. 5A
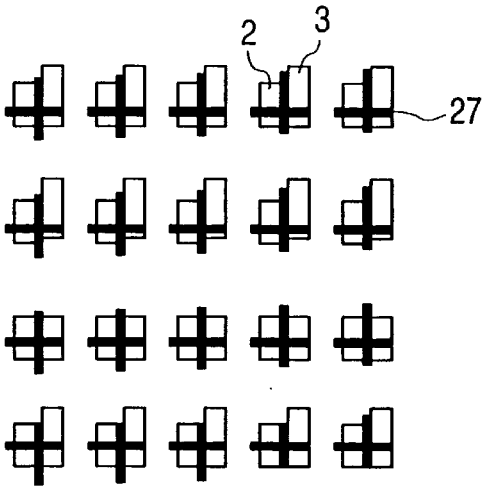
FIG. 5B
28
| | | | | |
|---|---|---|---|---|
| x11<br>y11 | x12<br>y12 | x13<br>y13 | x14<br>y14 | x15<br>y15 |
| x21<br>y21 | x22<br>y22 | x23<br>y23 | x24<br>y24 | x25<br>y25 |
| x31<br>y31 | x32<br>y32 | x33<br>y33 | x34<br>y34 | x35<br>y35 |
| x41<br>y41 | x42<br>y42 | x43<br>y43 | x44<br>y44 | x45<br>y45 |
| x51<br>y51 | x52<br>y52 | x53<br>y53 | x54<br>y54 | x55<br>y55 |
FIG. 5C
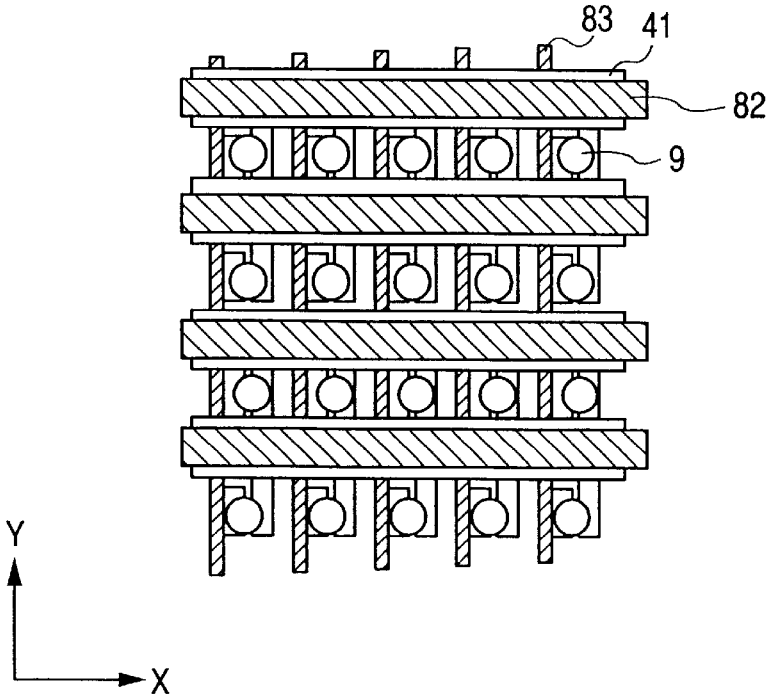

FIG. 6A
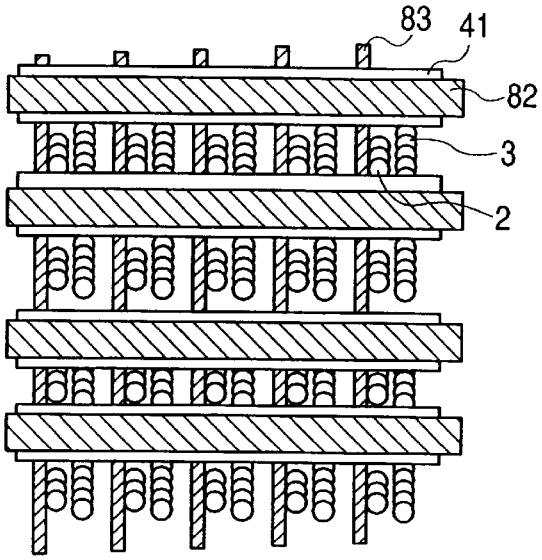
FIG. 6B
28
| | | | | |
|---|---|---|---|---|
| x11<br>y11 | x12<br>y12 | x13<br>y13 | x14<br>y14 | x15<br>y15 |
| x21<br>y21 | x22<br>y22 | x23<br>y23 | x24<br>y24 | x25<br>y25 |
| x31<br>y31 | x32<br>y32 | x33<br>y33 | x34<br>y34 | x35<br>y35 |
| x41<br>y41 | x42<br>y42 | x43<br>y43 | x44<br>y44 | x45<br>y45 |
| x51<br>y51 | x52<br>y52 | x53<br>y53 | x54<br>y54 | x55<br>y55 |
FIG. 6C
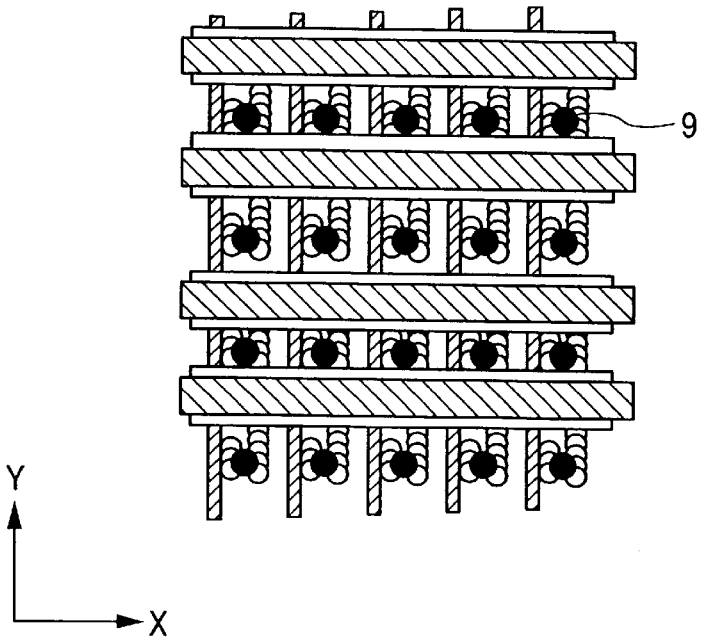

FIG. 7A
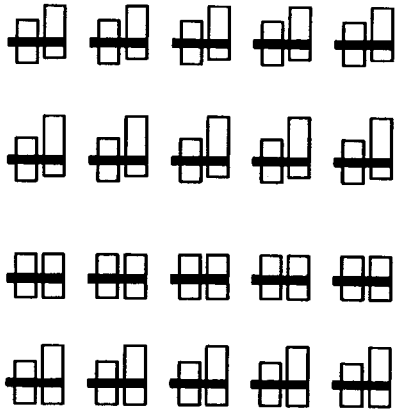
FIG. 7B
28
| | | | | |
|---|---|---|---|---|
| y11 | y12 | y13 | y14 | y15 |
| y21 | y22 | y23 | y24 | y25 |
| y31 | y32 | y33 | y34 | y35 |
| y41 | y42 | y43 | y44 | y45 |
| y51 | y52 | y53 | y54 | y55 |
FIG. 7C
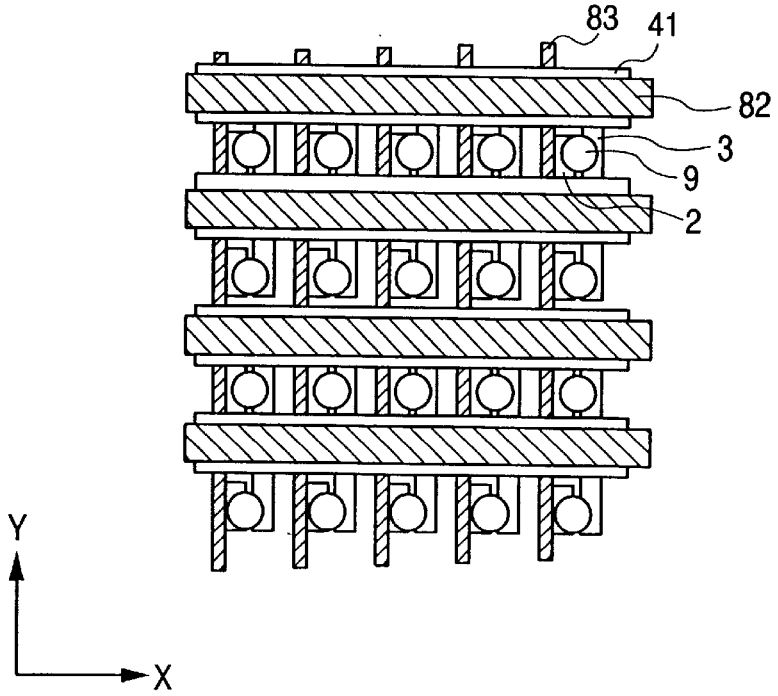

EMBODIMENT

EMBODIMENT

EMBODIMENT

FIG. 19A
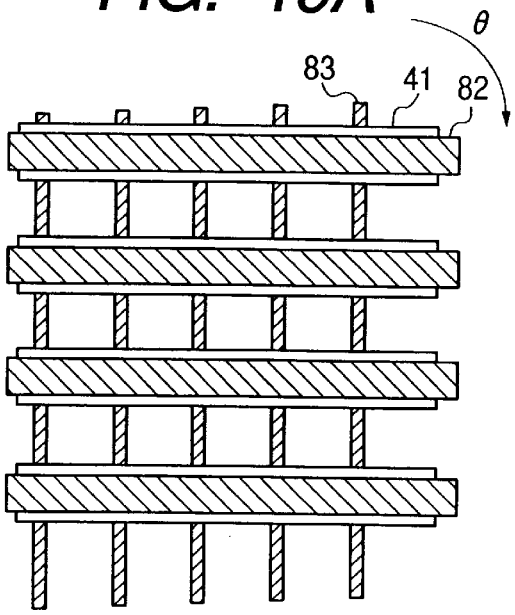
FIG. 19B
28
| | | | | |
|---|---|---|---|---|
| x11<br>y11 | x12<br>y12 | x13<br>y13 | x14<br>y14 | x15<br>y15 |
| x21<br>y21 | x22<br>y22 | x23<br>y23 | x24<br>y24 | x25<br>y25 |
| x31<br>y31 | x32<br>y32 | x33<br>y33 | x34<br>y34 | x35<br>y35 |
| x41<br>y41 | x42<br>y42 | x43<br>y43 | x44<br>y44 | x45<br>y45 |
| x51<br>y51 | x52<br>y52 | x53<br>y53 | x54<br>y54 | x55<br>y55 |
FIG. 19C
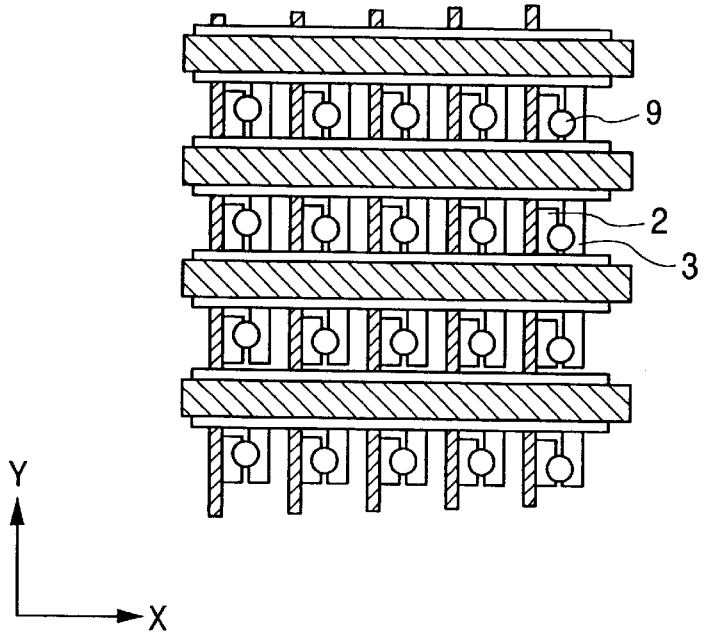

● =DEFECT

FILM FORMATION METHOD, METHOD FOR FABRICATING ELECTRON EMITTING ELEMENT EMPLOYING THE SAME FILM, AND METHOD FOR MANUFACTURING IMAGE FORMING APPARATUS EMPLOYING THE SAME ELEMENT

BACKGROUND OF THE INVENTION

1. Field of the Invention

The present invention relates to a method for forming a plurality of films, a method for fabricating an electron emitting element that employs those films, and a method for manufacturing an image forming apparatus that employs the electron emitting element.

2. Related Background Art

Conventionally, electron emitting elements are sorted into two types: a thermoelectron emitting element and a cold-cathode electron emitting element. The cold-cathode electron emitting element includes a field-effect emitting type (hereinafter referred to as an "FE type"), a metal/insulating layer/metal type (hereinafter referred to as an "MIM type") and a surface conductive type. A well known electron emitting element of the FE type is disclosed in, for example, "Field Emission," W. P. Dyke & W. W. Doran, Advance in Electron Physics, 8, 89 (1956) or "Physical Properties of Thin-film field Emission Cathodes with Molybdeniumcones," C. A. Spindt, J. Appl. Phys., 47, 5248 (1976).

A well known electron emitting element of the MIM type is disclosed in, for example, "Operation of Tunnel-Emission Devices," C. A. Mead, J. Appl. Phys., 32, 646 (1961).

A well known electron emitting element of a surface conductive type is disclosed in, for example, Radio Eng. Electron Phys., 10, 1290 (1965) by M. I. Elinson.

The electron emitting element of a surface conductive type supplies a current to a thin film, which is formed on a small area of a substrate that is parallel to the surface of the film, that emits electrons. Such electron emitting elements of a surface conductive type are the one disclosed above by Elinson that employs $SnO_2$ thin film, one that employs Au thin film (Thin Solid Films, 9, 317 (1972), G. Dittmer), one that employs $In_2O_3/SnO_2$ (IEEE Trans. ED Conf., 519 (1975), M. Hartwell and C. G. Fonstad), and one that employs a thin carbon film (Vacuum, Vol. 26, 1, page 22 (1983), Hisashi Araki, et al.).

In FIG. 17 is shown the arrangement of the element disclosed by M. Hartwell as a specific example of an electron emitting element of a surface conductive type. In FIG. 17, a substrate 1 and element electrodes 2 and 3 are provided for the emitting element. A thin conductive film 4 is a thin metal oxide film having a H-shaped pattern that is formed by sputtering, and an electron emitting portion 5 that is formed by an electrification process that is called electroforming, which will be described later. In FIG. 17, interval L between the element electrodes is set to 0.5 to 1 mm, and distance W' is set to 0.1 mm. The location and the shape of the electron emitting portion 5 are not fixed, and are specifically represented.

Generally, in a conventional electron emitting element of a surface conductive type, before the emission of electrons the electrification process called electroforming is performed for the thin conducive film 4, and the electron emitting portion 5 is formed. That is, the electroforming is the formation of the electron emitting portion by an electrification process. For example, a direct current voltage or a very gradually boosting voltage, such as 1 V/min., is applied to both ends of the thin conductive film 4 to locally destroy, or deform or degenerate the film 4, and the electron emitting portion 5 that electrically is highly resistant is formed. The electron emitting portion 5 emits electrons in the vicinity of a crack that occurs in one part of the thin conductive film 4. The electron emitting element for which the electroforming process has been performed applies a voltage to the thin conductive film 4 and permits the emission of electrons by the electron emitting portion 5.

Since the electron emitting element of a surface conduction type is easy to both form and arrange, multiple elements of this type can be formed and arranged in a large area. Therefore, various applications are being studied to determine the effective use of this characteristic. A load beam source and an image display device are examples of such applications.

In FIG. 18 is shown the arrangement of an electron emitting element disclosed in Japanese Patent Application Laid-Open No. 2-56822. In FIG. 18, the electron emitting element comprises: a substrate 1, element electrodes 2 and 3, a thin conductive film 4, and an electron emitting portion 5. Various methods are available for fabricating the substrate of the electron emitting element. For example, an ordinary vacuum deposition technique or photolithography technique is employed to form the element electrodes 2 and 3 on the substrate 1. Then, the thin conductive film 4 is formed by a dispersive coating method, following which a voltage is applied to the element electrodes 2 and 3, to electrify them and to form the electron emitting portion 5.

In addition, a further example is an electron source wherein multiple electron emitting elements of a surface conductive type are arranged in parallel to form multiple rows, and both ends (both of the element electrodes) of each electron emitting element are terminated by a wiring (also called a common wiring) e.g., Japanese Patent Application Laid-Open No. 64-1332, No. 1-283749 and No. 2-257552).

An example display device is proposed that can be fabricated so that it is as flat as a liquid crystal display device, but that is self-emitting and does not require a backlight. Such a display device comprises an electron source, wherein multiple electron emitting elements of a surface conductive type are arranged, and a fluophor that emits visible light upon irradiation with an electron beam originating at the electron source (U.S. Pat. No. 5,066,883).

The present inventor proposed a method, for fabricating an electron emitting element of a surface conductive type, that is advantageous for the formation of a conductive film to cover a large area, without resorting to the use of the vacuum sputtering method or the vacuum deposition method. According to another example method, an organic metal content solution is spinner-coated onto the substrate, and the film is patterned into a desired shape and is thermally cracked to form a conductive film. In addition, in Japanese Patent Application Laid-Open No. 8-171850 a method is proposed whereby, at a step in the patterning of a conductive film to provide a desired shape, droplets of an organic metal content solution are applied to the substrate using an ink-jet method, such as the bubble-jet method or the piezo-jet method, instead of the photolithography method, and a conductive film having a desired shape is formed.

According to the conventional ink-jet method described in Japanese Patent Application Laid-Open No. 8-171850, when wirings, an insulating layer and element electrodes can be fabricated as designed to form the substrate, the locations whereat it is determined the electron emitting portions are to be formed are arranged at intervals relative to a reference position on the electron source substrate. Therefore, when liquid droplets are ejected at a constant cyclic rate, as designed, they can be easily applied to the electron source substrate. However, in actuality, the widths and locations of the wirings and the insulating layer fabricated in or between the substrates by screen printing may vary. Thus, if the liquid droplets are applied as designed, when they contact the insulating layer and wirings they are absorbed, and no electron source is formed. Because of this defect, the resultant substrate can not fully satisfy the requirements for an electron source substrate.

SUMMARY OF THE INVENTION

According to the present invention, an innovative film formation method is provided. In particular, a method for accurately and efficiently forming a film is provided.

A film formation method according to one aspect of the present invention follows.

A method for forming a film locally on a substrate comprises the steps of:

detecting the state of the substrate;

employing the obtained result to calculate positional information concerning a plurality of locations at which the material for the film is to be provided to form the film; and providing the material for the film at the plurality of locations based on the positional information that is obtained for the plurality of locations.

Using this method, a film can be formed efficiently.

Further, the present invention can be preferably employed when the film is a conductive film. And in addition, the present invention can be preferably employed when the film is composed of a material used to constitute an electron emitting element of a surface conductive type.

The state of the substrate that is detected is the state of a portion wherein the material is to be provided, or an area in the vicinity of the portion.

The state of the substrate that is detected concerns image information for the substrate. More specifically, the state is detected by image input means, such as a CCD camera.

The state of the substrate that is detected concerns the arrangement of components on the substrate.

The state of the substrate that is detected concerns the arrangement of electrodes on the substrate. The present invention can be preferably employed when the electrodes are electrically connected to a conductive film.

The state of the substrate that is detected concerns the arrangement of wirings on the substrate. The wirings, for example, are electrically connected to a film, in particular, to a conductive film. For the electric connection, another electrode may be located between the wirings and the conductive film.

The state of the substrate that is detected concerns the arrangement of an insulating layer on the substrate. The insulating layer is used to limit conductivity between the wirings on the substrate.

The state of the substrate that is detected concerns the arrangement of a common wiring to which a plurality of films, in particular, conductive films, are electrically connected, or of a member that accompanies the common wiring. The state wherein the common wiring or the accompanying member is arranged is detected, and based on this result, the positional information is obtained that concerns the locations at which the material is to be deposited for the conductive films that are to be connected to the common wiring. Therefore, the required positional information can be obtained even if not all the states have been detected that are concerned with the locations at which the conductive films are to be provided that are to be connected to the common wiring. In addition, the member that accompanies the common wiring is, for example, a member that complements the function of the common wiring. Such a member is an insulating member used to electrically isolate the common wiring.

The substrate is an insulating element.

The calculation of the positional information includes a calculation of information that concerns a location at which the material is to be provided.

The step of calculating the positional information for the locations includes a step of employing, to calculate positional information for each of the plurality of locations, the detected state of the substrate that concerns locations that are fewer in number than the plurality of locations. For example, positional information concerning a location at which the state of the substrate has not been detected can be calculated by employing the detection result concerning another location.

The calculation of the positional information includes the calculation of a compensation value that is used to compensate for a control value for controlling the locations whereat the material is to be provided. The control value is that used for controlling the relative locations of the substrate and a unit for providing the material. The compensation value is that used for compensating for a difference between the locations whereat the material has to be provided and locations whereat the material is to be provided when the compensation is not performed.

The material can be provided in liquid form. The material can be an organic metal solution. The material can be provided by an ink-jet device. The ink-jet device may be one for outputting a liquid using thermal energy, e.g., for using thermal energy to generate air bubbles in a liquid to output the liquid, or may be one for outputting a liquid using dynamic energy, i.e., for outputting a liquid using a piezoelectric element.

The material is sequentially provided at the plurality of locations.

The material is provided at the plurality of locations by the same provision unit.

The material is provided at the plurality of locations by a plurality of provision units.

The material is sequentially provided at the plurality of locations while the relative locations of the provision unit and the substrate are changed.

The material is sequentially provided at the plurality of locations at each of several locations for the plurality of locations.

The plurality of locations are preferably arranged in columns or in rows. The present invention is especially preferable when an arrangement includes a plurality of columns or rows.

The film formation method may include a step of annealing the material that is provided. A film may be stabilized by annealing.

The present application includes the following three inventions. The above described invention can be applied to the following three inventions.

A method, for forming a plurality of conductive films that are to be electrically connected to a common wiring, comprises the steps of:

detecting the arrangement state of the common wiring or of a member that accompanies the common wiring;

employing the obtained result to calculate positional information concerning a plurality of locations at which is to be provided a material for the plurality of conductive films that are to be electrically connected to the common wiring; and providing at the locations, based on the positional information, the material for the conductive films.

This arrangement is preferable because, even when the states of the substrate that corresponds to all those locations are not detected, the positional information can be obtained for the locations at which the material for the conductive films is to be provided.

A method, for manufacturing an electron source including a plurality of electron emitting elements, comprises the steps of:

locally forming, on a substrate, conductive films that at least partially constitute the electron emitting elements, the step including detecting the state of the substrate, employing the obtained results to calculate positional information concerning a plurality of locations at which the material for the conductive films are to be provided to form the conductive films, and providing the material for the conductive films at the plurality of locations based on the positional information that is obtained; and forming an electron emitting unit in at least one part of each of the conductive films.

A method, for manufacturing an electron source having a plurality of electron emitting elements that are to be connected to a common wiring, comprises the steps of:

detecting the arrangement state of the common wiring or of a member that accompanies the common wiring;

employing the obtained result to calculate positional information concerning a plurality of locations at which is to be provided a material for the plurality of conductive films that are to be electrically connected to the common wiring;

providing at the locations, based on the positional information, the material for the conductive films; and forming an electron emitting unit in at least one part of each of the conductive films.

According to the method for manufacturing an electron source, the step of forming the electron emitting unit includes a step of electrifying the conductive films. The electron emitting elements are electron emitting elements of a surface conductive type.

BRIEF DESCRIPTION OF THE DRAWINGS

FIGS. 5A, 5B and 5C are schematic diagrams showing an image to be processed, a correction matrix table, and an electron source substrate according to a first embodiment of the present invention;

FIGS. 6A, 6B and 6C are schematic diagrams showing a correction matrix table, and an electron source substrate according to a second embodiment of the present invention;

FIGS. 7A, 7B and 7C are schematic diagrams showing an image to be processed, a correction matrix table, and an electron source substrate according to a third embodiment of the present invention;

FIGS. 19A, 19B and 19C are schematic diagrams illustrating an image to be processed, a correction matrix table, and an electron source substrate according to a fourth embodiment of the present invention;

DETAILED DESCRIPTION OF THE PREFERRED EMBODIMENTS

Embodiment 1

The present invention will now be described while referring to the accompanying drawings.

A flat electron emitting element of a surface conductive type will now be described while referring to FIGS. 9A and 9B.

Figure 9A:
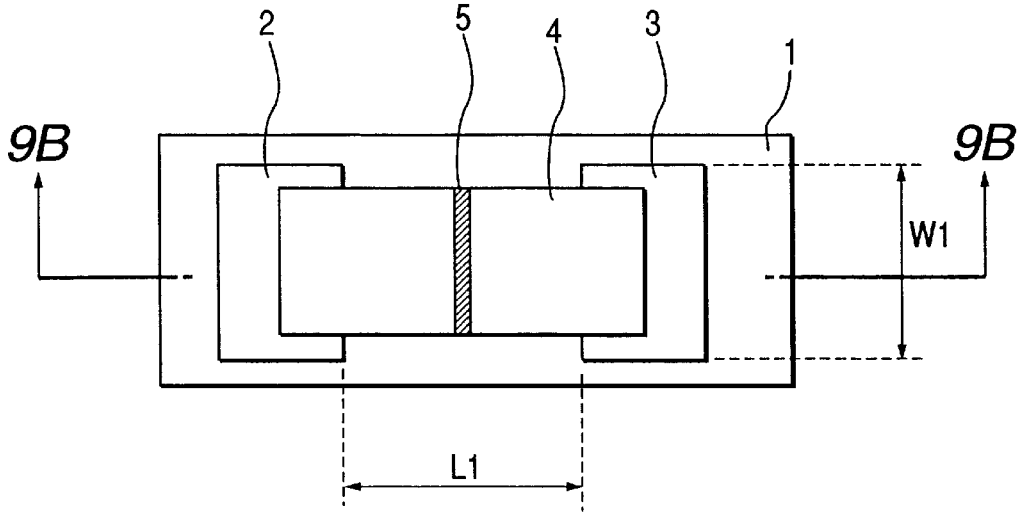
FIGS. 9A and 9B are a specific plan view, and a cross-sectional view of the arrangement of an electron emitting element of a surface conductive type that is fabricated using a method according to the present invention.
Figure 9B:
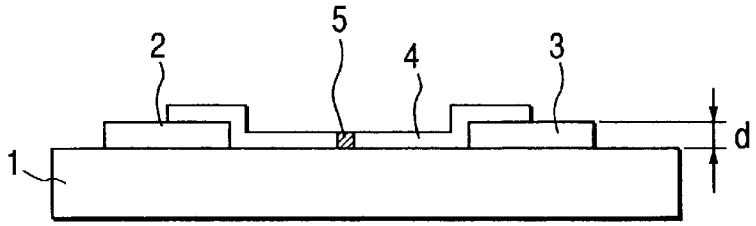

FIG. 9A is a specific plan view of the basic structure of a flat electron emitting element of a surface conductive type according to the preferred embodiments of the present invention, and FIG. 9B is a cross-sectional view taken along line 9B.

In FIGS. 9A and 9B, the electron emitting element comprises a substrate 1, element electrodes 2 and 3, a thin conductive film 4 and an electron emitting portion 5.

The substrate 1 can be one that is formed of silica glass or glass having a reduced content of an impurity such as Na, a blue sheet glass, a glass substrate wherein $SiO_2$ is deposited, or a ceramics substrate formed of alumina.

An ordinary conductive material is employed to form the element electrodes 2 and 3, and can be selected from among the metals, or alloys of, Ni, Cr, Au, Mo, W, Pt, Ti, Al, Cu or Pd; a print conductor that consists of a metal, or a metal oxide of, Pd, As, Ag, Au, $RuO_2$ or Pd—Ag, and glass; a transparent conductive material, such as $In_2O_3$—$SnO_2$; and a semiconductor conductive material, such as polysilicon.

The interval L1 between the element electrodes 2 and 3 is preferably several hundreds of Å to several hundreds of $\mu$m. Since it is preferable that a low voltage be applied to the element electrodes 2 and 3, and since reproducible fabrication of the element is requested, an adequate interval L1 is several $\mu$m to several tens of $\mu$m. The length W1 of the element electrode 2 or 3 is several $\mu$m to several hundreds of $\mu$m, in accordance with the resistance and electron emitting characteristic of the electrodes. The film thickness d of the element electrodes 2 and 3 is preferably several hundreds of Å to several $\mu$m. More preferably, adequate shapes of, and an adequate interval between the element electrodes are determined in accordance with the distribution of the thin conductive film 4.

In order to obtain a desirable electron emitting characteristic, it is particularly preferable that the thin conductive film 4, in which is located the electron emitting portion 5, be formed of particulates. The thickness of the film 4 is adequately set in accordance with the states of the element electrodes 2 and 3 and an electroforming condition, which will be described later. The thickness of the film 4 is preferably several Å to several thousands of Å, and more preferably 10 to 500 Å. The sheet resistance is $10^2$ to $10^7$ Ω/□.

The material used for forming the thin conductive film 4 can be one of the metals Pd, Pt, Ru, Ag, Au, Ti, In, Cu, Cr, Fe, Zn, Sn, Ta, W or Pb; an oxide of PdO, $SnO_2$, $In_2O_3$, PbO or $Sb_2O_3$; a boride of $HfB_b$, $ZrB_2$, $LaB_6$, $CeB_6$, $YB_4$ or $GdB_4$; a carbide of TiC, ZrC, HfC, TaC, SiC or WC; a nitride of TiN, ZrN or HfN; a semiconductor of Si or Ge; or carbon.

The particulate film is a set of a plurality of particulates. In the micro-structure of the film, not only are individual particles dispersed and arranged, but also the particles are positioned adjacent to each other or are overlapped (including particles that are arranged in the shape of an island). The diameter of a particle can be several Å to several thousands of Å, but is preferably 10 to 200 Å.

An explanation will now be given of one method, according to a first embodiment of the present invention, that is used to form a thin conductive film for the electron emitting element of a surface conductive type.

Figure 1:
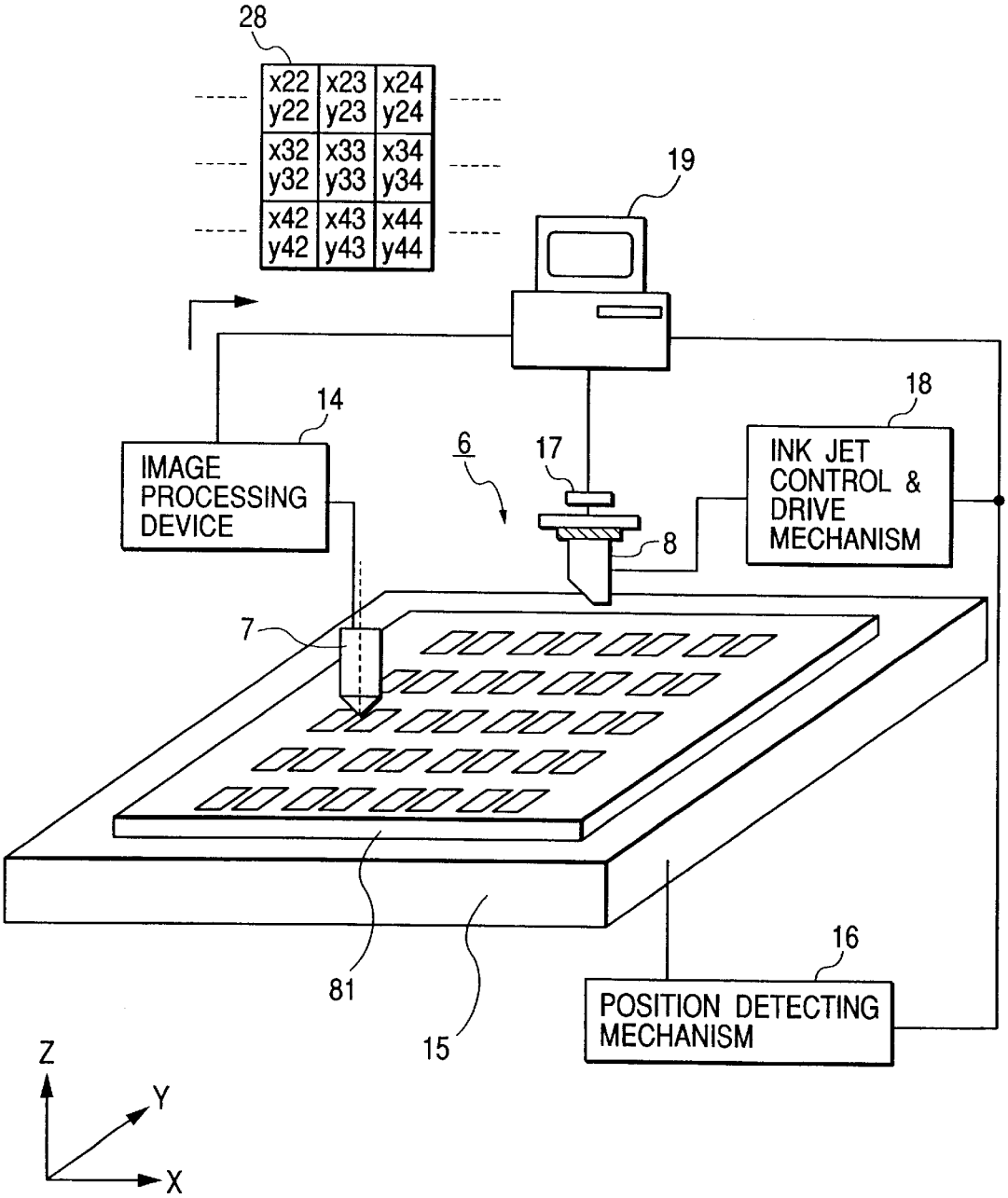
FIG. 1 is a schematic diagram illustrating an apparatus used for correcting a location at which a liquid droplet is to be deposited.
Figure 2:
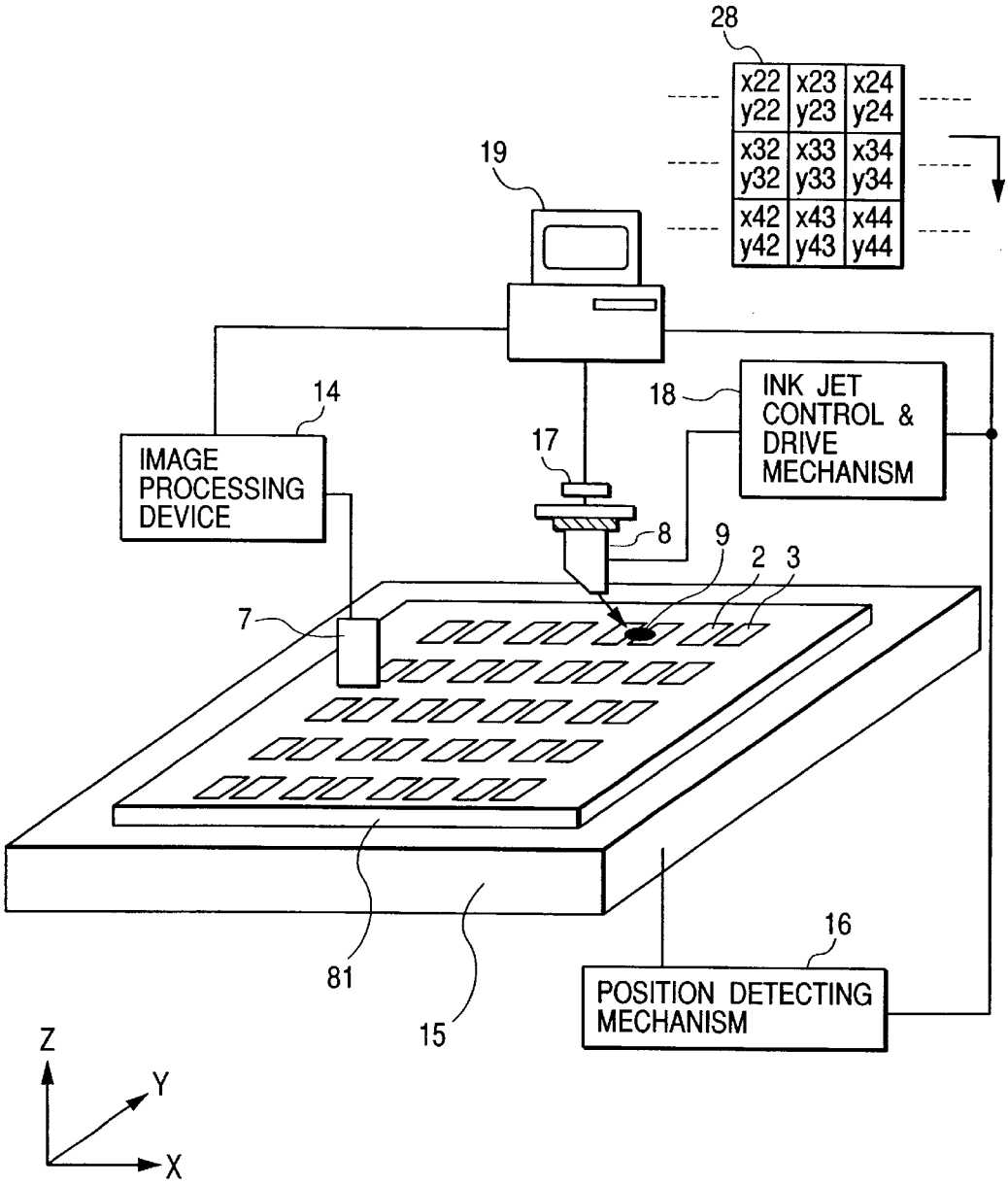
FIG. 2 is a schematic diagram illustrating the apparatus used for correcting a location at which a liquid droplet is to be deposited.
Figure 3:
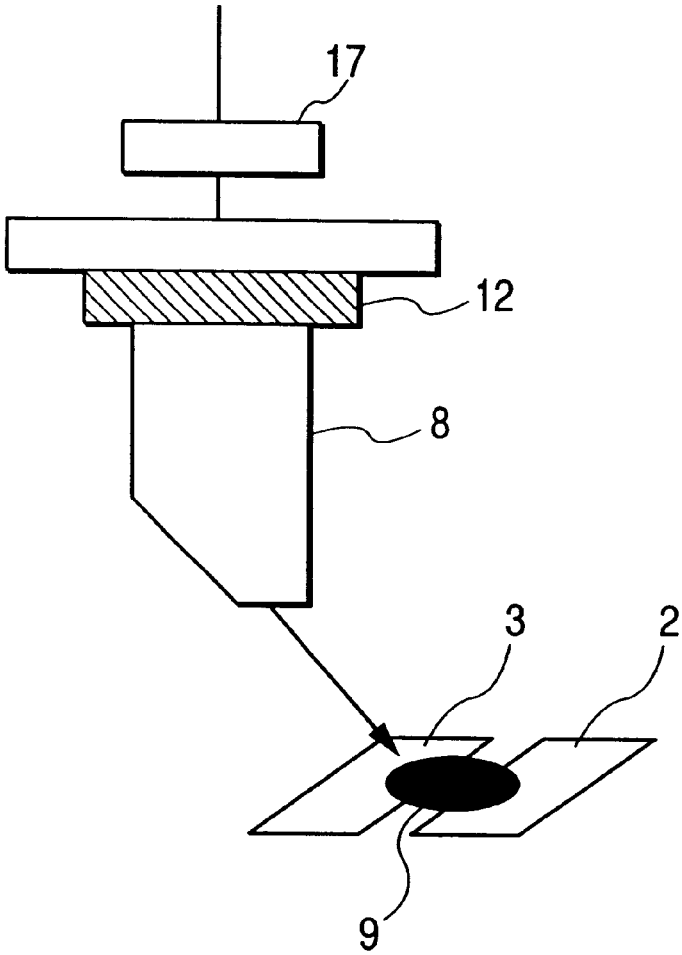
FIG. 3 is a schematic diagram illustrating the arrangement of an ejection head unit.

FIGS. 1 and 2 are schematic diagrams illustrating an apparatus used for correctly positioning the droplets of a solution that are deposited to form a thin conductive film. FIG. 3 is a schematic diagram illustrating the arrangement of an ejection head unit. In FIGS. 1 to 3 are shown element electrodes 2 and 3; an ejection head unit 6; a CCD camera unit 7; an ink-jet head 8; a liquid droplet 9; an image processing device 14; an electron source substrate (wirings and an insulating layer are not shown) 81; a head alignment mechanism 12; a stage 15, for which an XY direction scanning mechanism (not shown) is provided; a position detecting mechanism 16 (which employs a laser displacement device to detect the positioning of the stage); a position correction mechanism 17, for controlling the head alignment mechanism 12; an ink-jet control and drive mechanism 18; a computer 19; and a correction matrix table 28.

Any type of apparatus that can form arbitrarily shaped liquid droplets can be employed as the ejection head unit 6. Preferably, an ink-jet apparatus is used that can control the ejection of more than ten ng to several tens of ng, and that can form a liquid droplet composed of a minute amount comprising several tens of ng or more. The type of ink-jet type apparatuses used includes a system (a bubble-jet system) that employs thermal energy to generate air bubbles in a solution and that ejects the solution as a consequence of the generation of air bubbles, and a system (a piezo-jet system) that employs dynamic energy to eject a solution.

The material of which the liquid droplet 9 is composed may be maintained in an arbitrary state wherein droplets can be formed. An organic metal solution in which is dispersed one of the above described metals, and that is prepared by dissolving the metal in water, or another solvent, can be employed as the material for the liquid droplet 9. When, for example, palladium is selected as the element or the chemical compound to be employed for the thin conductive film, the material can be compounded as an aqueous solution that contains an ethanolamine complex, such as a palladium acetate-ethanolamine complex (PA-ME), a palladium acetate-diethanol complex (PA-DE), a palladium acetate-triethanolamine complex (PA-TE), a palladium acetate-butylethanolamine complex (PA-BE) or a palladium acetate-dimethylethanolamine complex (PA-DME). The liquid droplet 9 is ejected by the ink-jet head 8 and is deposited at a desired location between the element electrodes 2 and 3. According to the present invention, a correction is performed for a shift between design values on the substrate whereon are formed the wirings, the insulating layer and the element electrodes. The correction method will now be described while referring to the flowchart in FIG. 20.

1. An image is obtained by the CCD camera unit 7, and the center of gravity of a pattern of region at which liquid droplet has to be deposited is calculated by the image processing device 14.

2. The center of gravity of the pattern is obtained using the positional information for the center of gravity of the pattern, and the positional information obtained by the position detecting mechanism 16, which detects the position of the stage 15 on which is mounted the XY direction scanning mechanism. Based on the center of gravity that is obtained, a target liquid provision position (a measurement value) is detected by the computer 19. Then, the measurement value is compared with the design value, and the correction matrix table 28 is prepared by the computer 19 (FIG. 1).

3. Following this, the ink-jet head 8 is moved relative to the substrate in accordance with the correction matrix table 28, and the liquid droplet 9 is deposited at a desired location between the element electrodes 2 and 3 on the electron source substrate 81. For the correction of a location based on the correction matrix table 28, the value of the correction matrix table 28 is transmitted by the computer 19 to the position correction mechanism 17, which then drives the head alignment mechanism 12 to slightly adjust the positioning of the head 8 (FIG. 2). The image processing device 14 can be a device for calculating the center of gravity of a binary image lying within a constant range, a device for performing a differential calculation for an image lying within a specific range and for extracting the outline of a member in order to calculate a predetermined position, or a device for matching a pattern with an ideal image (a pattern as originally designed) in order to calculate a predetermined position. A device that is presently available on the market can used to implement the above image processing.

In order to precisely deposit liquid droplets, the pre-ejection of liquid droplets is performed before the liquid is deposited between the element electrodes (an area on the substrate wherein pre-ejection is permitted, or a pre-ejected portion obtained on the stage outside the substrate is employed), and the relationship between the position of the ink-jet head 8 and the location at which a liquid droplet is deposited is measured.

The electron substrate 81 is annealed at a temperature of 300 to 400° C., and the thin conductive film 4 is formed thereon.

The electron emitting portion 5 is a highly resistant crack that is formed in the thin conductive film 4 by electroforming. Conductive particles having a diameter of several Å or several hundreds of Å may be present in the crack. The conductive particles include at least one part of the element employed for the thin conductive film 4. The electron emitting portion 5 and the thin conductive film in its vicinity may contain carbon or a carbon compound.

In the electroforming process, the element electrodes 2 and 3 are electrified by a power source (not shown), and the thin conductive film 4 is locally destroyed, deformed or degenerated to form a portion in which the structure is changed. The local portion wherein the structure is changed is called the electron emitting portion 5. Example voltage waveforms for the electroforming are shown in FIGS. 10A and 10B.

A pulse waveform is preferable as the voltage waveform. An explanation will now be given for a case wherein a voltage pulse having a constant pulse pitch is sequentially applied (FIG. 10A) and a case wherein a voltage pulse is applied while increasing the pulse pitch (FIG. 10B).

Figure 10A:
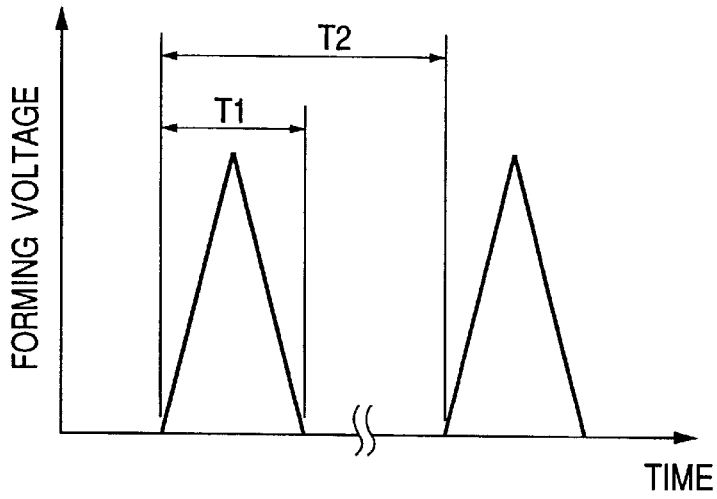
FIGS. 10A and 10B are graphs, each of which show an example drive pulse that is supplied during a forming process.

In FIG. 10A, T1 and T2 represent the pulse width and the pulse interval of a voltage wave. T1 is defined as 1 μsecond to 10 m seconds, and T2 is defined as 10 μseconds to 100 m seconds. The pitch of a triangular wave (the peak voltage during the electroforming) is selected in accordance with the state of the electron emitting element of a surface conductive type. A voltage is applied for several seconds to several tens of minutes in an atmosphere in which is maintained an adequate vacuum, e.g., approximately $10^{-5}$ Torr. The wave applied to the element electrodes is not limited to a triangular wave, and a desired wave, such as a rectangular wave, may be employed.

Figure 10B:
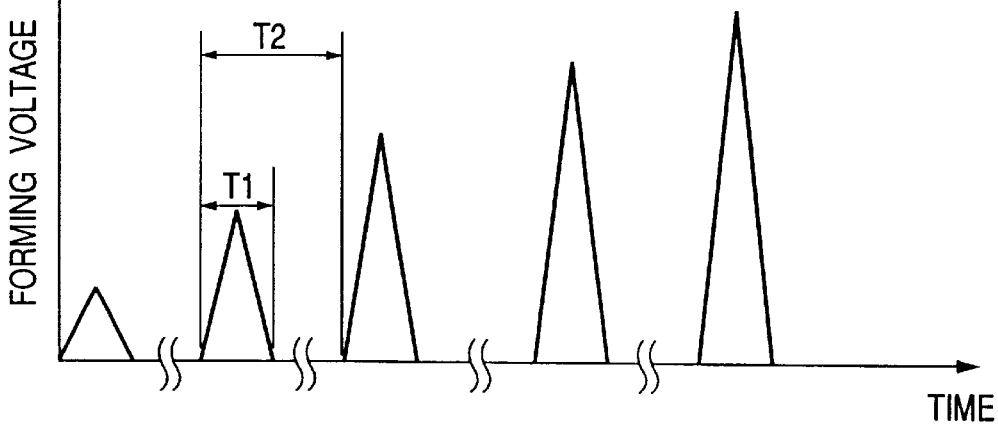

In FIG. 10B, T1 and T2 are defined the same as in FIG. 10A. A voltage is applied in an atmosphere in which an adequate vacuum is maintained, while the pitch (peak voltage during the electroforming) of a triangular wave is gradually increased by, for example, 0.1 V.

During the electroforming process, at pulse interval T2 an element current is measured using a voltage at which the thin conductive film 4 will not be locally destroyed or deformed, i.e., a voltage of 0.1 V, and the resistance is obtained. When the resistance is equal to or higher than, for example, 1 MΩ, the electroforming is terminated.

After the electroforming has been completed, a so-called activation process is performed for the resultant element. During this process, element current If and emission current Ie are changed drastically.

During the activation process, the application of a pulse is repeated in an atmosphere containing an organic gas. This atmosphere can be provided by introducing an adequate amount of organic gas into a vacuum container from which a sufficient volume of air has been evacuated. Such an organic material is an aliphatic hydrocarbon, such as alkane, alkene or alkyne; an aromatic hydrocarbon; alcohol; aldehyde; ketone; amine; phenol; or an organic acid, such as carboxylic acid or sulfonic acid. Through the activation process, due to the organic material that is contained in the atmosphere, a filling consisting of carbon or a carbon compound is deposited inside the crack that was previously formed by carbon or a carbon compound during the electroforming.

It is preferable that the electron emitting element obtained during the activation process be stabilized. For the stabilization process, the organic material is removed from the vacuum container. It is preferable that the vacuum pump used for the removal of air from the vacuum container be one for which oil is not used for lubrication, so that the characteristic of the element will not be affected by oil contributed by the device. A specific vacuum pump can be a sorption pump or an ion pump. In addition, it is preferable that the vacuum container be heated so that organic material molecules that are attached to the internal wall of the container and the electron emitting element can be easily discharged. Preferably, the conditions under which air is discharged from the vacuum container include the heating of the container to a temperature of 150 to 300° C. and the discharging of the air over a period of several hours or longer. However, the conditions are not thereby limited, and adequate conditions can be selected in accordance with the size and shape of the vacuum container and the arrangement of the electron emitting element. The pressure in the vacuum container must be reduced as much as possible, preferably, to a pressure of 1 to $3\times10^{-7}$ Torr or lower. An even more preferable pressure would be $1\times10^{-8}$ Torr or lower.

A method for manufacturing an image forming apparatus according to the present invention will now be described.

The electron source substrate used for the image forming apparatus is prepared by arranging on it a plurality of electron emitting elements of a surface conductive type.

Figure 8:
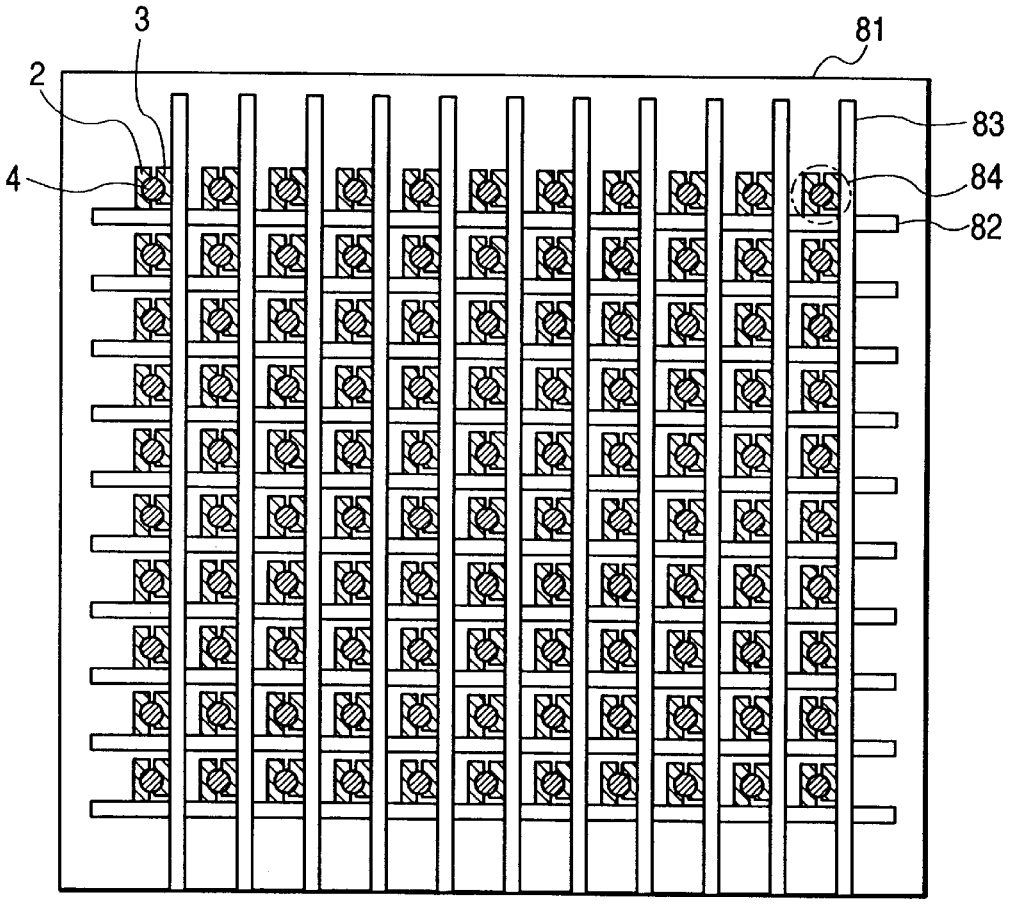
FIG. 8 is a specific diagram illustrating an electron source substrate having a matrix-shaped arrangement.

The types of arrangements used for the electron emitting elements of a surface conductive type are a rudder-shaped arrangement wherein electron emitting elements of a surface conductive type are positioned in parallel, with both ends of each element being connected to a wiring (a layout hereinafter referred to as an electron source substrate having a rudder-shaped arrangement), and a simple matrix arrangement wherein an X directional wiring and a Y directional wiring are connected to one of a pair of element electrodes for each of the electron emitting elements of a surface conductive type (a layout hereinafter referred to as an electron source substrate having a matrix-shaped arrangement). The image forming apparatus, to include the electron source substrate having the rudder-shaped arrangement, requires a control electrode (grid electrode) for controlling the emission of electrons by the electron emitting element. FIG. 8 is a plan view of an example electron source substrate having the matrix-shaped arrangement that employs the electron emitting elements of a surface conductive type. In FIG. 8 the same numerals as are used in FIG. 1 are also employed to denote corresponding components, and an electron source substrate 81, X directional wirings 82, Y directional wirings 83 and electron emitting elements of a surface conductive type 84 are additionally provided.

Figure 11:
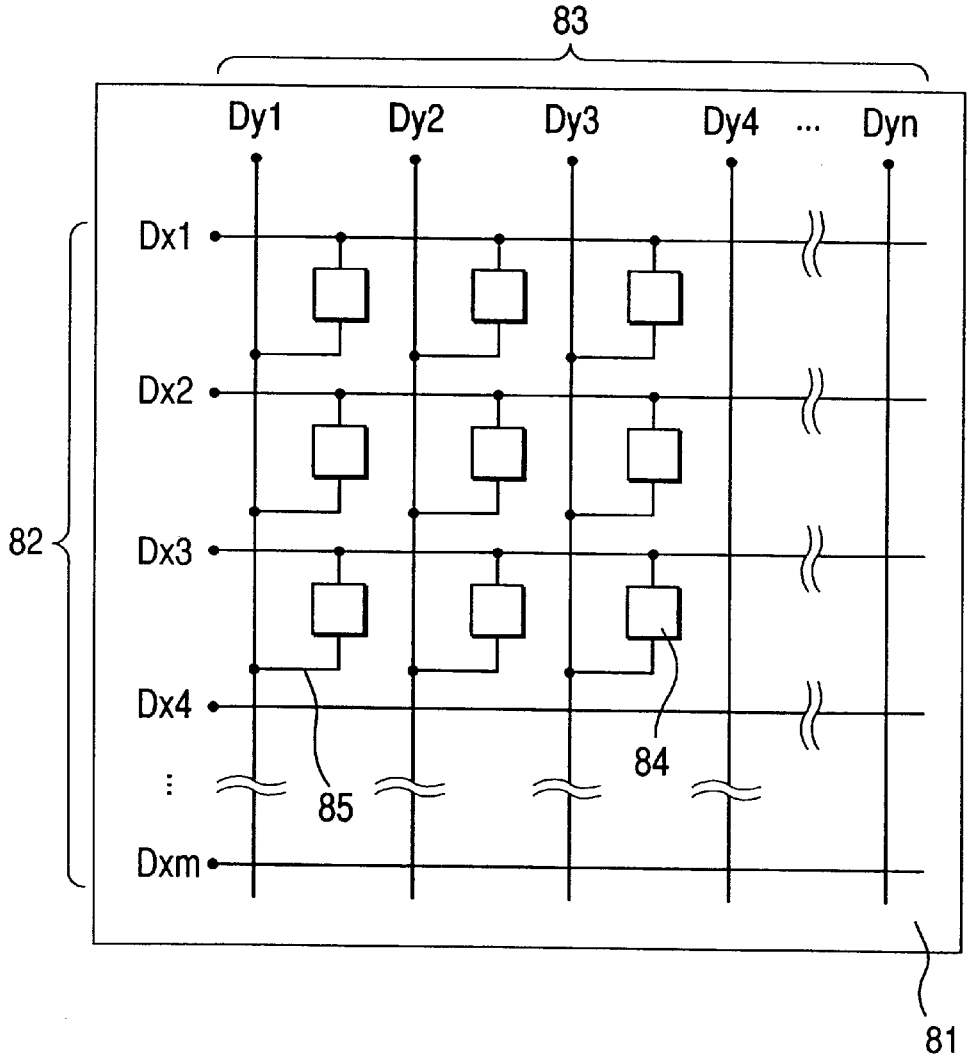
FIG. 11 is another specific diagram illustrating an electron source having a matrix-shaped arrangement.

The structure of an electron source obtained by the fabrication method of the present invention will now be described while referring to FIG. 11. In FIG. 11, the same reference numerals as used in FIG. 8 are also employed to denote corresponding components, and connection wirings 85 are provided.

In FIG. 11, the electron source substrate 81 is the previously mentioned glass substrate, and an adequate shape is established in accordance with the application. The X directional wirings 82 are m wirings, Dx1, Dx2, . . . and Dxm, and the Y directional wirings 83 are n wirings, Dy1, Dy2, . . . and Dyn.

The wirings can be made of a conductive metal that is formed by the vacuum deposition method, the printing method, or the sputtering method. The material of the wiring, the thickness of the film, and the width of the distance between the wirings are adequately set, so that a substantially equal voltage is applied to multiple electron emitting elements of a surface conductive type. The m X directional wirings 82 and the n Y directional wirings 83 (m and n are positive integers), are electrically separated by an insulating interlayer (not shown) to constitute a matrix-shaped wiring arrangement.

The insulating interlayer (not shown) is formed of $SiO_2$ by vacuum deposition, printing, or sputtering. The thickness and the material of the insulating interlayer and its formation method are so determined that, for example, the layer is formed in a desired shape on all or one part of the substrate 81 on which the X directional wirings 82 are arranged, and that the layer can be capable of resisting a potential difference at each of the intersections of the X directional wirings 82 and the Y directional wirings 83. The X directional wirings 82 and the Y directional wirings 83 are led out as external terminals.

The electron emitting elements of a surface conductive type are electrically connected by the m X directional wirings 82, the n Y directional wirings 83, and the connection wirings 85.

The elements of which the material for the wirings 82 and 83 is composed, the material for the connection wirings 85, and the material used for a pair of element electrodes may be all or partially the same, or all of them may be different. These materials are selected as needed from among the above described materials used for the element electrodes. When the same material is employed to form element electrodes and the wirings, a wiring connected to an the element electrode can also be regarded as an element electrode.

The electron emitting elements of a surface conductive type may be formed on either the substrate or the insulating interlayer.

As will be described later in detail, the X directional wirings 82 are electrically connected to scan signal transmission means (not shown) that in accordance with an input signal scan the X directional rows of the electron emitting elements of a surface conductive type.

The Y directional wirings 83 are electrically connected to modulation signal generation means (not shown) that in accordance with an input signal transmits a modulation signal for modulating the Y directional columns of the electron emitting elements of a surface conductive type.

A drive voltage to be applied to the individual electron emitting devices of a surface conductive type is supplied as a differential voltage between a scan signal and a modulation signal that are transmitted to the elements.

With this arrangement, the individual elements can be selected and independently driven merely by the simple matrix-shaped connection.

Figure 12:
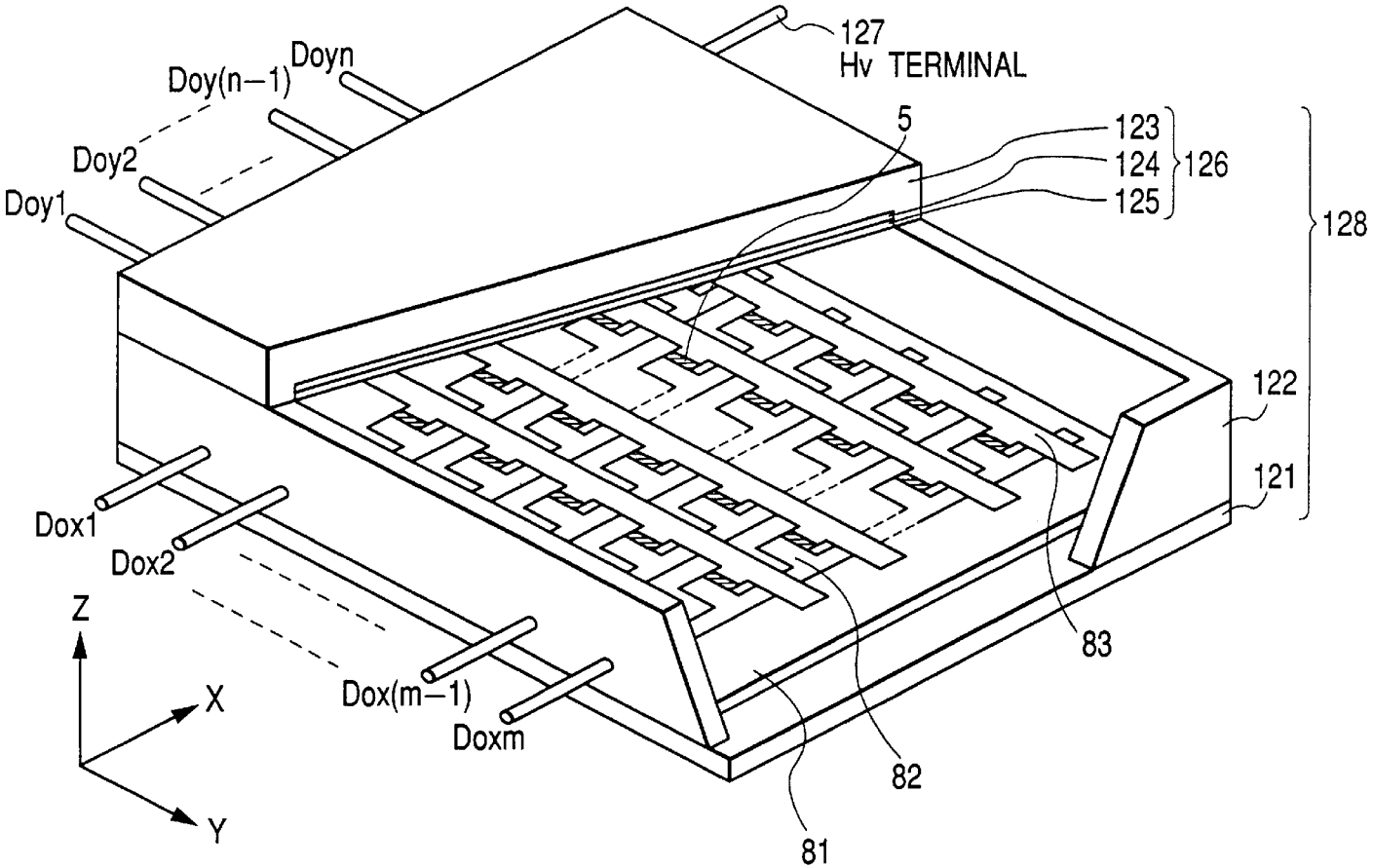
FIG. 12 is a schematic diagram illustrating an image forming apparatus employing an electron source having a matrix-shaped arrangement.
Figure 13A:
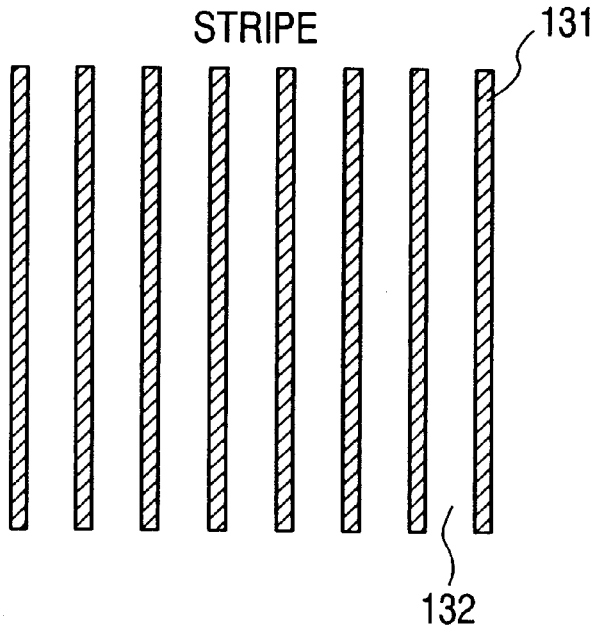
FIGS. 13A and 13B are diagrams showing fluophor films patterns.
Figure 13B:
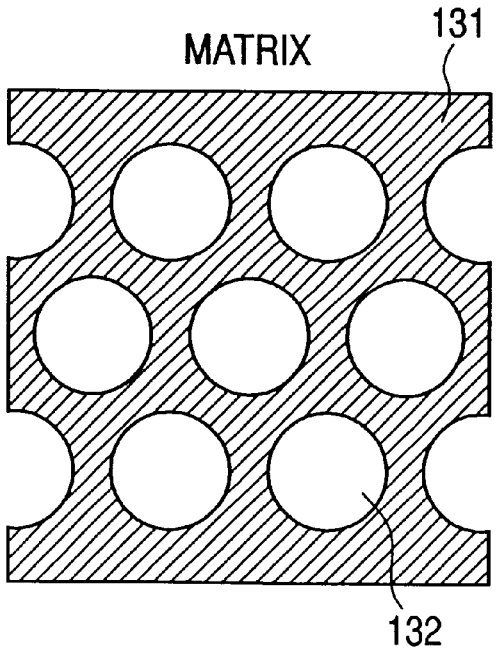
Figure 14:
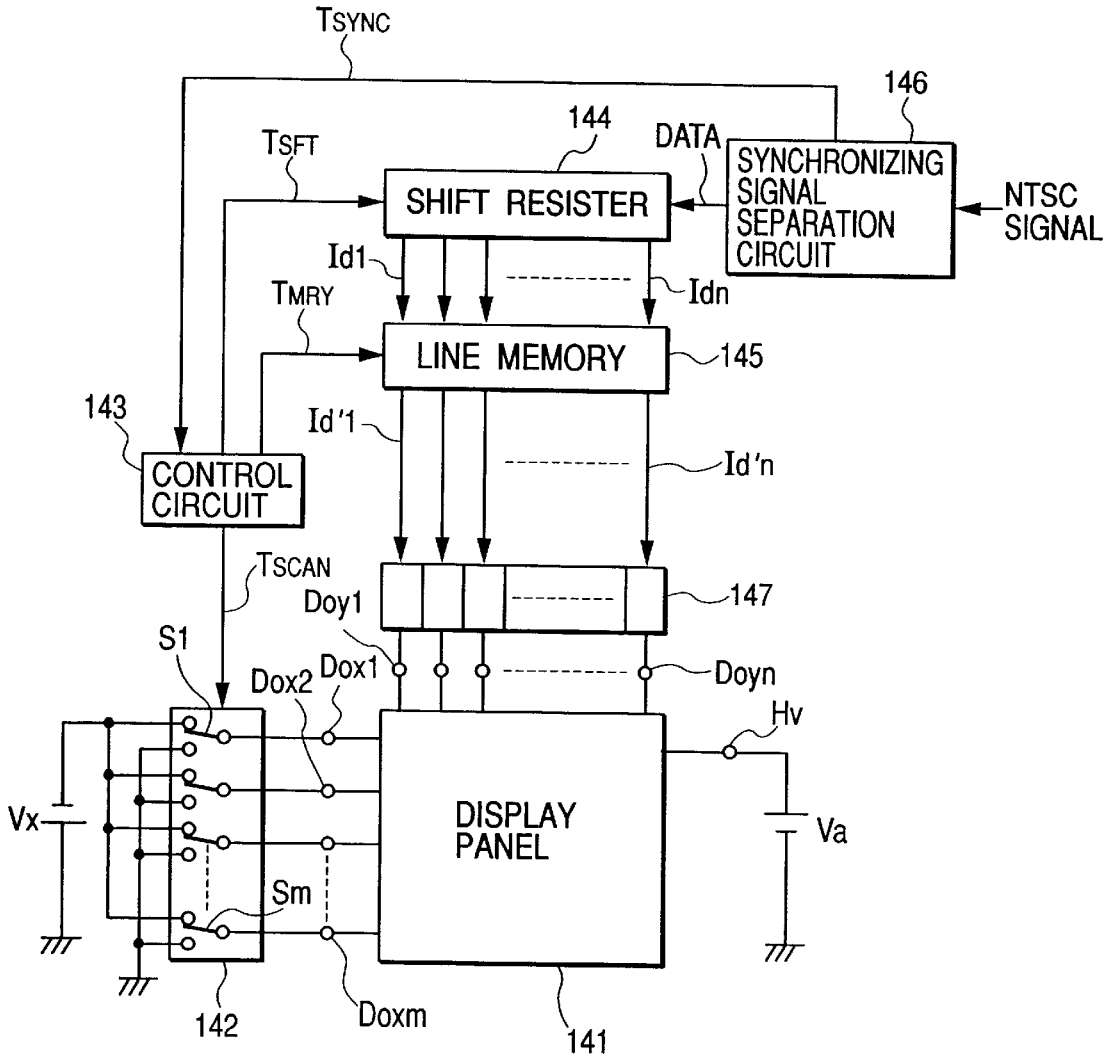
FIG. 14 is a block diagram illustrating an example drive circuit that, in accordance with an NTSC signal, provides a display for the image forming apparatus.

The image forming apparatus employing the thus formed electron source with the simple matrix-shaped arrangement will now be described while referring to FIGS. 12, 13A and 13B, and 14. FIG. 12 is a diagram illustrating the basic arrangement of the display panel of the image forming apparatus; FIGS. 13A and 13B are specific diagrams showing a fluophor film used for the image forming apparatus in FIG. 12; and FIG. 14 is a block diagram illustrating the image forming apparatus that includes a drive circuit for providing a display in accordance with an NTSC signal. In FIG. 12, a plurality of electron emitting elements of a surface conductive type are mounted on an electron source substrate 81. A rear plate 121 is fixed to the electron source substrate 81. A face plate 126 is prepared by forming a fluophor film 124 and a metal back 125 inside a glass substrate 123. Frit glass is applied to the rear plate 121, a support frame 122 and the face plate 126, and is closely attached thereto by annealing the resultant structure, for ten minutes or longer, at a temperature of 400 to 500° C. in the atmosphere or in nitrogen. As a result, an externally enclosed container 128 is provided.

In FIG. 12, a portion 5 corresponds to an electron emitting portion. Connected to pairs of element electrodes of the electron emitting elements of a surface conductive type are X directional wirings 82 and Y directional wirings 83. The container 128 is constituted by the face plate 126, the support frame 122, and the rear plate 121, which 121 is provided mainly to reinforce the electron source substrate 81. So long as the electron source substrate 81 is strong enough, the rear plate 121 need not be provided. Therefore, support frame 122 may be directly attached to the electron source substrate 81, and the container 128 may be constituted by the face plate 126, the support frame 122 and the electron source substrate 81. Another container 128 that can satisfactorily resist the air pressure may be constituted by providing an anti-air pressure support member, called a spacer, between the face plate 126 and the rear plate 121. When the fluophor film 124 (FIG. 12) is a monochrome film, it can be constituted only by a fluophor 132 in FIGS. 13A and 13B. When the fluophor film 124 is a color film, it is constituted by black conductive members 131 and fluophors 132, it is called a black stripe or a black matrix in accordance with the fluopher array. The black stripe or the black matrix is prepared so that, for a color display, the portions among the fluophors 132 for the three primary colors that are required are provided with black so as to prevent a color mixture from being noticeable, and so that a reduction in contrast due to the reflection of external light on the fluophor film 124 is limited. The black stripe is composed of a material that not only contains graphite, which is commonly employed, as its primary element, but also another material through which little light is transmitted and by which little is reflected. The method used for coating the glass substrate with the fluophor can be the precipitation method or the printing method, regardless of whether a monochrome fluophor film or a color fluophor film is used.

Generally, the metal back 125 is provided on the internal face of the fluophor film 124 (FIG. 12). The purposes for which the metal back 125 is provided are an improvement in luminance by the reflection at the face plate 126 of the light that is emitted by the fluophor and is transmitted to the internal face; the application as an electrode for an electron beam acceleration voltage; and the protection of the fluophor from damage by the impact of a negative ion that is generated in the externally enclosed container. To fabricate the metal back 125, the fluophor film 124 is formed, then a smoothing process (generally called "filming") is performed for the internal surface of the fluophor film 124 and Al is deposited thereon using vacuum deposition.

For the face plate 126, a transparent electrode (not shown) may be formed on the external face of the fluophor film 124 in order to improve the conductivity of the fluophor film 124. When color fluophors are employed, these fluophors and the electron emitting elements of a surface conductive type must be precisely aligned and positioned in order to attach the components 121, 122 and 126 closely together.

Air is removed from the container 128 through an air discharge pipe (not shown), so that the container is sealed by a vacuum at a pressure of $10^{-7}$ Torr.

A getter process may be performed to maintain the vacuum in the sealed container 128. For this process, immediately before or after the container 128 is sealed, the getter located at a predetermined position (not shown) in the container 128 is heated using a resistance heating method or a high-frequency heating method, and a film is applied. The getter primarily contains Ba, and a vacuum at a pressure of, for example, $1\times10^{-5}$ to $1\times10^{-7}$ Torr is maintained by the vacuum deposition of the film. Whether to perform this process is determined as needed, after the electroforming of the electron emitting element of a surface conductive type is completed.

While referring to a schematic block diagram in FIG. 14, an explanation will be given for an arrangement wherein a drive circuit for providing a television display, in accordance with an NTSC signal, is employed for an image forming apparatus that includes an electron source having a substrate with a simple matrix-shaped arrangement. In FIG. 14, the drive circuit comprises an image display panel 141; a scan circuit 142; a control circuit 143; a shift register 144; a line memory 145; a synchronization signal separation circuit 146; a modulation signal generator 147; and direct-current power sources Vx and Va.

The functions of the individual sections will now be described. First, the display panel 141 is connected to an external electric circuit, via terminals Dox1 to Doxm and Doy1 to Doyn, and to a high voltage terminal Hv.

A scan signal is transmitted to the terminals Dox1 to Doxm to sequentially drive, row by row (n elements), the electron emitting elements of a surface conductive type that are connected to form a matrix of m rows and n columns.

A modulation signal is transmitted to the terminals Doy1 to Doyn to control an electron beam that is emitted by each of the electron emitting elements of a surface conductive type in a row that is selected by the scan signal. A direct current of, for example, 10 KV is supplied to the high voltage terminal Hv by a direct-current power source Va. This voltage is an acceleration voltage to provide, for an electron beam that is emitted by the electron emitting element of a surface conductive type, sufficient energy to excite the fluophor.

The scan circuit 142 will now be explained. The scan circuit 142 includes m switching elements (S1 to Sm, specifically shown in FIG. 14). The switching elements S1 to Sm are used to select either a voltage output by the direct-current power source Vx or 0 V (ground level), and to transmit the selected voltage to the terminals Dox1 to Doxm of the display panel 141. The switching elements S1 to Sm are operated in accordance with a control signal Tscan that is output by the control circuit 143, and can actually be constituted by combining such switching elements as FETs.

Based on the characteristic (electron emitting threshold value) of the electron emitting elements of a surface conductive type, the direct-current power source Vx is so set that it outputs a constant voltage such that a drive voltage that is to be applied to an electron emitting element that is not driven is equal to or lower than the electron emitting threshold value.

The control circuit 143 adjusts the operations of the individual sections so as to provide an adequate display in accordance with an externally received image signal. Control signals Tscan, Tsft and Tmry are generated in accordance with a sync signal Tsync that is received from the synchronization signal separation circuit 146, which will be described below.

The synchronization signal separation circuit 146 divides an externally received NTSC signal into a sync signal element and a luminance signal element. A frequency separation (filter) circuit can be employed to constitute the synchronization signal separation circuit 146. As is well known, the sync signal obtained by the synchronization signal separation-circuit 146 includes a vertical sync signal and a horizontal sync signal. In this embodiment, a sync signal Tsync is shown for convenience sake. The image luminance signal obtained from the NTSC signal, which is represented as a signal DATA for convenience sake, is transmitted to the shift register 144.

The shift register 144 performs, for each line of an image, a serial/parallel conversion of the signal DATA that is serially received in a time series. Operation of the shift register 144 is initiated upon the receipt of the control signal Tsft from the control circuit 143. That is, the control signal Tsft can be regarded as a shift lock for the shift register 144. The data for one line of the image, which are obtained by the serial/parallel conversion and which correspond to data for driving Nn electron emitting elements of a surface conductive type, are output by the shift register 144 as n parallel signals, ID1 to Idn.

The line memory 145 is a storage device for storing, for a required period of time, data for one line of the image. The contents of the signals ID1 to Idn are stored in the line memory 145 in accordance with the control signal Tmry that is transmitted by the control circuit 143. The stored contents are output to the modulation signal generator 147 as image data ID1 to Idn.

The modulation signal generator 147 is a signal generator for, upon receiving the image data ID1 to Idn, adequately driving or modulating the electron emitting elements of a surface conductive type. The modulation signal generator 147 outputs a signal to the electron emitting elements in the display panel 141 via the terminals Doy1 to Doyn.

As was described above, the electron emitting element of the present invention has the following characteristic relative to emitting current Ie. As previously described, since a specific threshold value Vth is provided for the emission of electrons, electrons are discharged only upon the application of a voltage equal to or higher than the threshold value Vth. Further, the discharged current is varied in accordance with a change in the voltage that is applied to the element and that is equal to or higher than the electron emitting threshold value. The electron emitting threshold value Vth, and the degree of change in the discharged current, relative to the applied voltage, may be varied by employing a different material and arrangement for the electron emitting elements and a different fabrication method. In all the cases, the following statements can be established as being true.

When a voltage having a pulse shape is applied to the electron emitting element of the present invention, electrons are not emitted upon the application of a voltage having a lower value than an electron emitting threshold value, while an electron beam is output upon the application of a voltage equal to or higher than the threshold value. At this time, first, the intensity of the electron beam can be controlled by changing the pitch Vm of the pulse.

Second, the total amount of electric charges of the emitted electron beam can be controlled by changing the pulse width Pw. Therefore, the voltage modulation method and the pulse width modulation method can be employed to modulate the electron emitting elements in accordance with an input signal. To implement this voltage modulation method, a modulation signal generator 147 is employed for generating a voltage pulse having a constant length, and for changing the pitch of a pulse as needed in accordance with the input data.

To implement the pulse width modulation method, the modulation signal generator 147 is employed for generating a voltage pulse having a constant pitch and for changing the width of the voltage pulse as needed in accordance with the input data.

Through the above described processing, the image display apparatus of the present invention can provide a television display using the display panel 141. Although not specifically described, both the shift register 144 and the line memory 145 can be either a digital signal type or an analog signal type, so long as the serial/parallel conversion for the image signal and the storage of the image signals can be performed at a predetermined speed.

When a shift register 144 and a line memory 145 of a digital signal type are employed, the signal DATA output by the synchronization signal separation circuit 146 must be digitized. In this case, an A/D converter need merely be provided at the output portion of the circuit 146. Therefore, in accordance with whether the signal from the line memory 145 is digital or analog, a slightly different circuit is used for the modulation signal generator 147.

An explanation will be given first for a case wherein a digital signal is output by the line memory 145. When the voltage modulation method is employed, merely a well known A/D converter, for example, need be employed for the modulation signal generator 147; as needed, an amplification circuit may be additionally provided. When the pulse width modulation method is employed, the modulation signal generator 147 can be constituted by a circuit that is comprises a high-speed oscillator, a counter for counting the number of waves output by the oscillator, and a comparator for comparing the count value held by the counter with a value output from the memory. As needed, an amplifier may be additionally provided for amplifying, up to a drive voltage adequate for the electron emitting elements, the voltage of a modulation signal having a changed pulse that is output by the comparator.

Next, an explanation will be given for a case wherein an analog signal is output by the line memory 145. Only an amplification circuit that includes a well known operational amplifier need be employed for the modulation signal generator 147 of the voltage modulation type. As needed, a level shift circuit may be additionally provided. For the pulse width modulation type, only a well known voltage control oscillation circuit (VCO) need be employed. As needed, an amplifier may be additionally provided for amplifying the voltage of a modulation signal until it equals the drive voltage for the electron emitting element of a surface conductive type.

In the thus arranged image display apparatus of the present invention, the individual electron emitting elements of a surface conductive type emit electrons upon the application of a voltage via the terminals Dox1 to Doxm and Doy1 to Doyn. A high voltage is applied, via the high voltage terminal Hv, to the metal back 125 or to transparent electrodes (not shown). The electron beam is accelerated to irradiate the fluophor film 124, which when thus excited emits light. As a result, an image can be displayed.

The above described arrangement is required for the fabrication of a preferred image forming apparatus to be used for displaying an image. The detailed portions, such as the materials used for the individual members, are not limited to those described above, and can be selected as needed in accordance with the intended application of the image forming apparatus. The NTSC signal is employed as an example input signal, but the signal that can be used is not thereby limited, and can be a PAL signal, an SECAM signal or another type. Furthermore, a TV signal (e.g., high quality TV, such as the MUSE) consisting of multiple scan lines may be employed.

While referring to FIGS. 15 and 16, an explanation will be given for the electron source having a rudder-shaped arrangement and the image forming apparatus that employs such an electron source.

Figure 15:
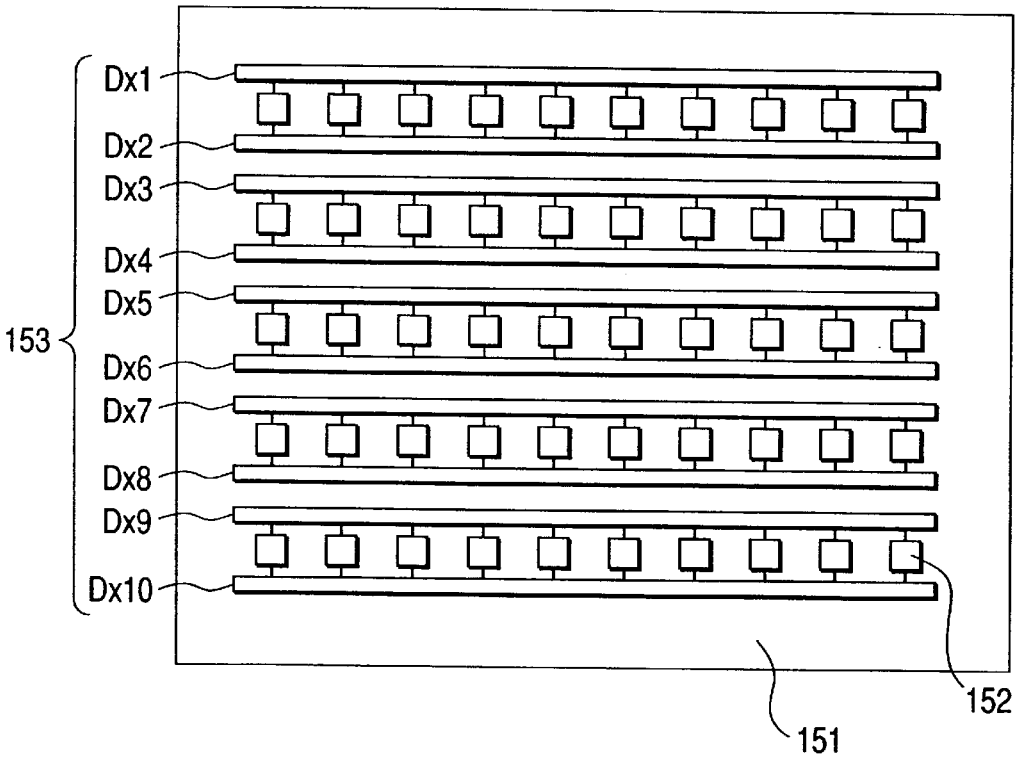
FIG. 15 is a specific diagram illustrating an electron source substrate having a rudder-shaped arrangement.

FIG. 15 is a specific diagram illustrating an example electron source having a rudder-shaped arrangement. In FIG. 15, the electron source includes an electron source substrate 151, electron emitting elements of a surface conductive type 152, and common wirings Dx1 to Dx10 153, which are connected to the electron emitting elements 152. The electron emitting elements 152 are arranged in parallel, in direction X, along a plurality of rows (hereinafter called element rows) on the substrate 151. A plurality of element rows are so arranged as to form an electron source substrate having the rudder-shaped arrangement.

The element rows can be independently driven by the application of a drive voltage between the common wirings of the rows. That is, a voltage that is equal to or higher than the voltage emitting threshold value must be applied to each of the element rows by which an electron beam is to be emitted, while a voltage lower than the threshold value must be applied to each of the element rows for which the emission of an electron beam is inhibited. Of the common wirings Dx2 to Dx9 located between the element rows, the wirings lying adjacent to each other, such as Dx2 and Dx3 or Dx4 and Dx5, may be connected together to form a single wiring to be used in common.

Figure 16:
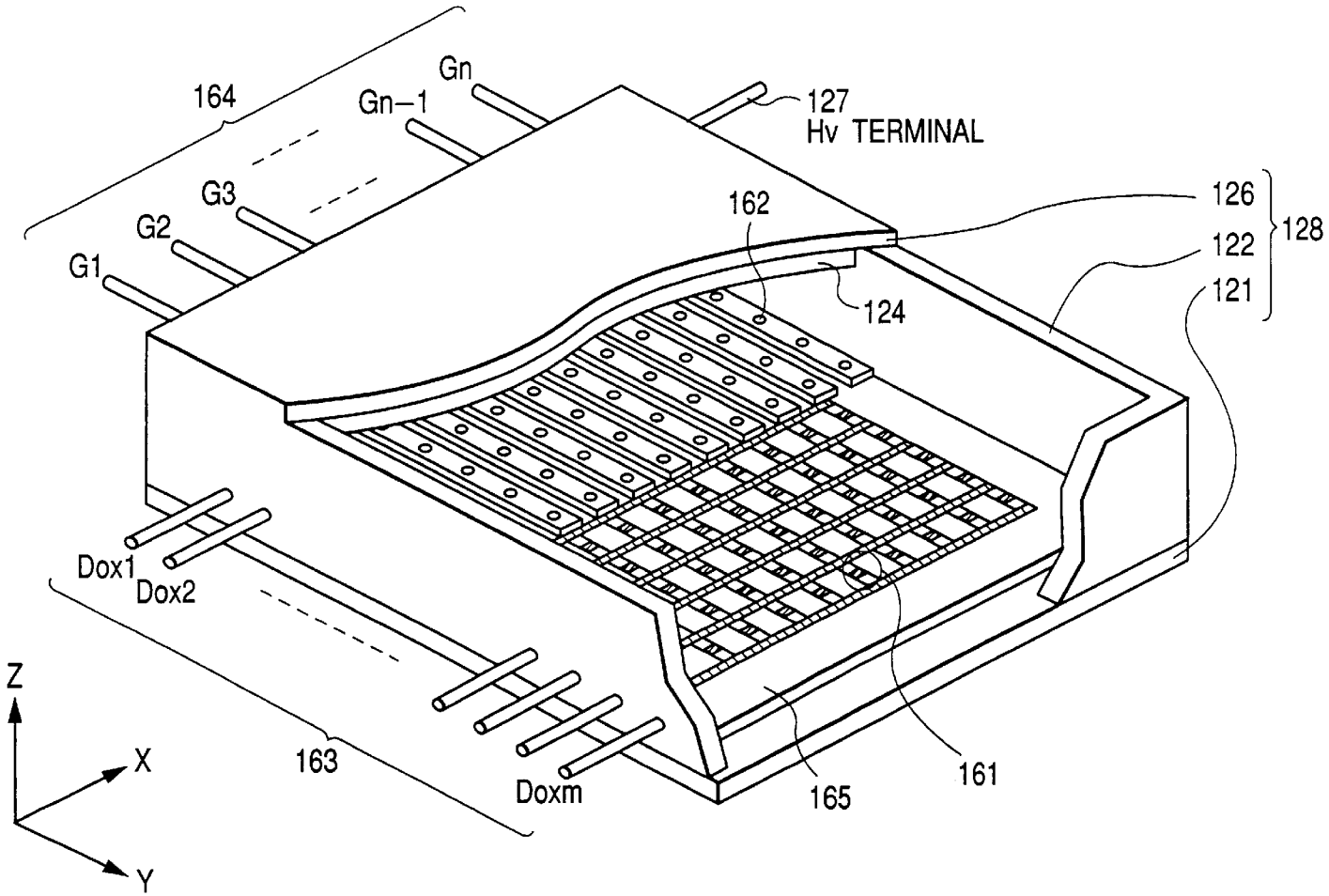
FIG. 16 is a schematic diagram illustrating the arrangement of an image forming apparatus that employs an electron source having a rudder-shaped arrangement.
Figure 17:
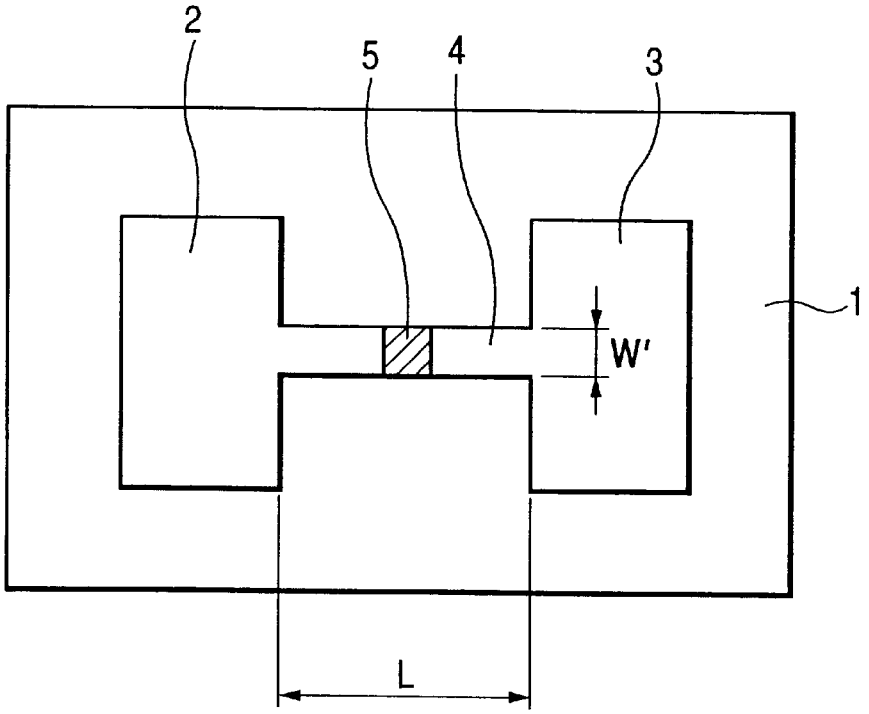
FIG. 17 is a specific plan view of a conventional electron emitting element.
Figure 18:
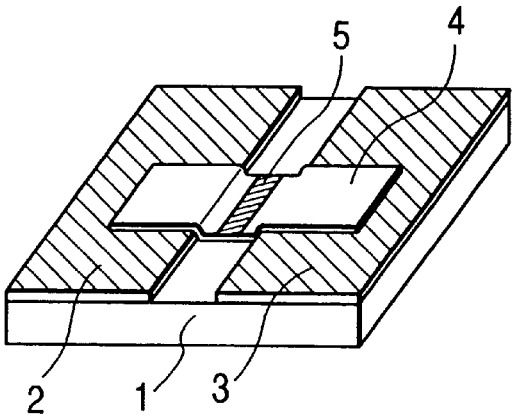
FIG. 18 is a specific perspective view of another conventional electron emitting element.

FIG. 16 is a diagram showing the structure of an image forming apparatus that includes an electron source having the rudder-shaped arrangement. The image forming apparatus includes grid electrodes 161; through holes 162, through which electrons pass; external terminals 163, i.e., Dox1, Dox2, . . . and Doxm; external terminals 164, i.e., G1, G2, . . . and Gn, which are connected to the grid electrodes 161; and an electron source substrate 165, which provides the same common wirings located between the individual element rows. In FIG. 16, the same reference numerals as are used in FIGS. 12 to 13B are used to denote corresponding components. This apparatus differs from the image forming apparatus having the simple matrix-shaped arrangement (FIG. 12) in that the grid electrodes 161 are provided between an electron source substrate 81 and a face plate 126.

Each of the grid electrodes 161 changes an electron beam that is emitted by the electron emitting element. Since an electron beam is passed through the striped electrodes 161 that are located perpendicular to the rudder-like element rows, one circular opening 162 is formed for each electron emitting element. The shape of the grid electrodes and their locations are not limited to those shown in FIG. 16. For example, multiple through holes can be formed that resemble a mesh.

The external terminals 163 and 164 are electrically connected to a control circuit (not shown). elements. While there are various methods that can be used for detecting the optimal position, in this embodiment one image is obtained at electrode 2 and one at electrode 3 of an electron emitting element, and the contrasting images are digitized. Then, the position at the center of gravity for a specific digital contrast portion is calculated. At this time, the expansion and reduction process and the embedding process for a digital image may be additionally performed in order to increase the accuracy of the digital images. In this embodiment, a general-purpose image processing device CS-902, produced by Fast Corp., that can perform the above described processing is employed as the image processing device 14. However, another device that can perform the desired image processing can be employed.

The thus obtained image information (the position at the center of gravity) and the positional information that is obtained by the position detecting mechanism 16, which detects the position of the stage 15 that includes the XY direction scanning mechanism, are employed to acquire information concerning the positioning at the center of gravity of the individual electron emitting element on the electron source substrate 81 on the stage 15. The information concerning the positioning at the center of gravity is transmitted to the computer 19. conductive type on the electron source substrate 81 have the same arrangement as those in FIG. 8 (the X and the Y directional wirings are not shown). Each of the electron emitting elements, as well as the one shown in FIGS. 9A and 9B, comprises the substrate 1, the element electrodes 2 and 3, and the thin conductive film 4. The CCD camera unit 7 is located at a position, above the electron source substrate 81, from which it can view the upper surface of the substrate 81. The ejection head unit 6 is provided for the application of liquid droplets.

In this embodiment, the ejection head unit 6 is fixed to a liquid droplet provision device. The electron source substrate 81 is moved to an arbitrary position by the stage 15, which includes the XY direction scanning mechanism, so that the ejection head unit 6 and the electron source substrate 81 are moved relative to it. The relationship between the position of the ejection head unit 6 (the ink jet head 8) and the position of the substrate 81 at which a liquid droplet 9 is ejected is measured before the liquid droplet 9 is applied between the element electrodes. An image obtained by the CCD camera unit 7 is transmitted to the image processing device 14, and is processed there. As a result, the optimal position at the center of gravity for depositing the liquid droplet 9 can be detected for individual electron emitting In the image forming apparatus in this embodiment, a modulation signal for one lime of an image is transmitted to rows of grid electrodes in synchronization with the one by one driving (scanning) of the element rows. As a result, the irradiation by the electron beams of the fluophors can be controlled, and an image can be displayed for each line.

The image forming apparatus provided by the manufacturing method of the present invention can be used as a display device for television programs, a display device for a television conference system or for a computer, and an optical printer that includes a photosensitive drum.

The features of the first embodiment are most exactly shown in FIGS. 1 and 2, i.e., a liquid droplet providing device that correctly positions itself when depositing liquid droplets. FIG. 3 is an enlarged, schematic diagram showing the ejection head unit 6 in FIGS. 1 and 2. An explanation will now be given for the arrangement of these devices and the method used for the fabrication of an electron source substrate that employs these devices.

In FIG. 1, the stage 15 includes an XY direction scanning mechanism (not shown) for moving the electron source substrate 81 in the directions X and Y. The electron source substrate 81 is mounted on the stage 15. The electron emitting elements of a surface The structure of the ejection head unit 6 will be described while referring to FIG. 3. The ink jet head 8 for depositing a liquid droplet 9 on the electron source substrate 81 is connected to the image forming apparatus via the head alignment mechanism 12. The ink jet head 8 can be moved and repositioned by the position correction mechanism 17. The head alignment mechanism 12 is constituted by a piezoelectric element that is driven in directions X and Y, and can be precisely displaced in either or both directions.

The ink jet head 8 is driven by the ink jet head control and drive mechanism 18 to eject, at an arbitrary timing, a liquid droplet 9 from the ink jet head 8. The ink jet head control and drive mechanism 18 is controlled by the computer 19. An ink jet head of a piezo-jet type is employed in this embodiment.

An explanation will now be given, while referring to FIGS. 4A to 4D and FIGS. 5A to 5C. FIGS. 4A to 4D are plan views of wirings formed as designed and of wirings whose locations have been shifted and do not correspond to design values. FIGS. 5A to 5C are respectively a diagram for an image to be processed, a correction matrix table and a schematic diagram showing the electron source substrate 81.

Figure 4A:
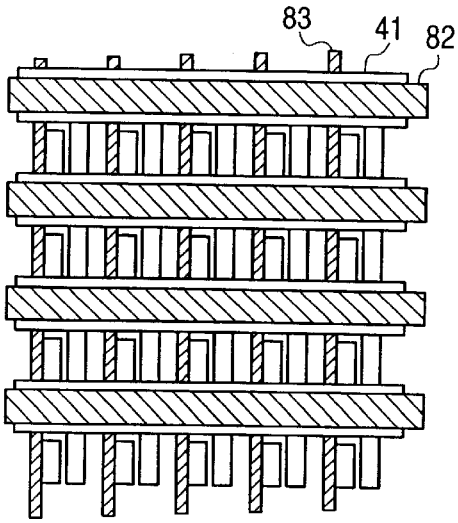
FIGS. 4A, 4B, 4C and 4D are plan views of wirings formed as designed, and wirings that are shifted from designed values.
Figure 4B:
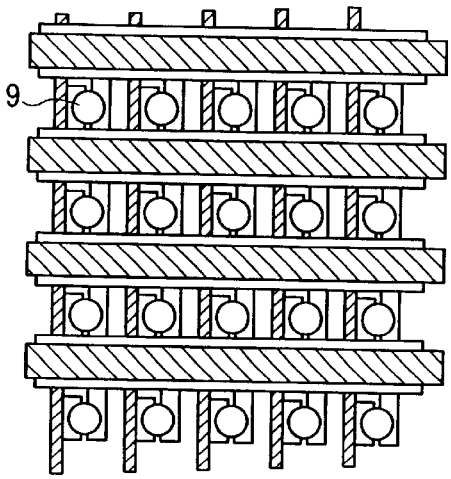
Figure 4C:
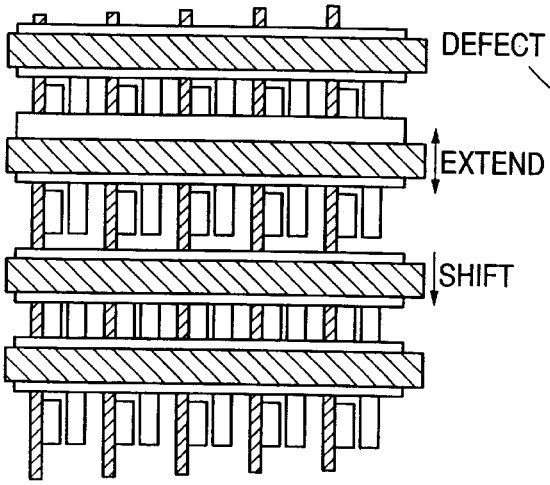

In FIG. 4A are shown the element electrodes and wirings formed as designed, and in FIG. 4C are shown the element electrodes and the wirings whose locations have been shifted and do not correspond to design values but are close to being correctly arranged.

In FIG. 5A, a position 27 indicates the center of gravity of a liquid droplet provision pattern obtained by the image processing. A correction matrix table 28 is prepared after the computer 19 compares a design target coating position (design value) with an actual target coating position (measurement value), which is calculated by using the positional information that is obtained for the stage 15 by the position detecting mechanism 16 and the image information (the center of gravity) that is obtained by the CCD camera unit 7. The liquid droplet 9 is applied after its position has been corrected. In FIGS. 4A to 5C, the insulating layer 41 is provided.

While referring to FIGS. 1 to 5C and FIGS. 9A and 9B, an explanation will now be given for the method used for fabricating the electron source substrate that employs this liquid droplet provision device.

A soda lime glass was employed as the insulating substrate 1. This substrate 1 was washed thoroughly using an organic solvent and was dried at 120° C. A plurality of element electrode pairs of Pt were formed on the substrate 1 at an electrode interval of 20 $\mu$m using vacuum film deposition or photolithography. Then, the X and Y wirings 82 and 83 and the insulating layer 41 were formed using screen printing in order to apply a voltage to the element electrode pairs. The wirings were arranged as a matrix.

Figure 4D:
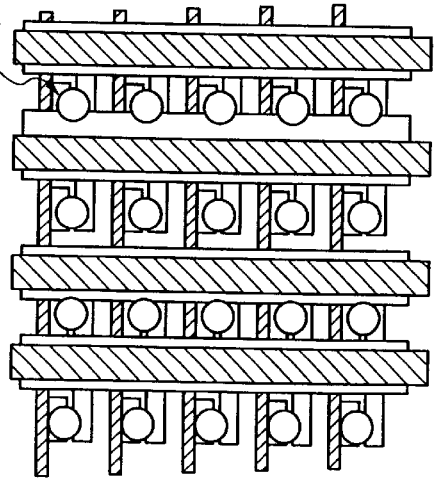
Figure 4D:
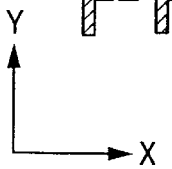

If the individual electron emitting elements can be fabricated as designed (FIG. 4A), the electron emitting portions are supposed to be located at predetermined intervals relative to a reference position on the electron source substrate. When the stage 15, which includes the XY direction scanning mechanism, for moving the substrate is displaced at a constant speed, and when the ink jet head control and drive mechanism 18 synchronously ejects liquid droplets at constant intervals, these droplets can be easily applied to the electron source substrate 81 (FIG. 4B). However, in actuality, the widths and the positions of the wirings and the insulating layer that were fabricated in and between the substrate using screen printing were varied (FIG. 4C). When a liquid droplet 9 was applied as designed using the above described method but without the positioning being corrected as in the present invention, the liquid droplet 9 contacted the insulating layer and the wirings and was absorbed thereby, so that the electron source could not be formed. Further, the resultant structure was rendered defective and did not fully serve as an electron source substrate (FIG. 4D).

Figure 20:
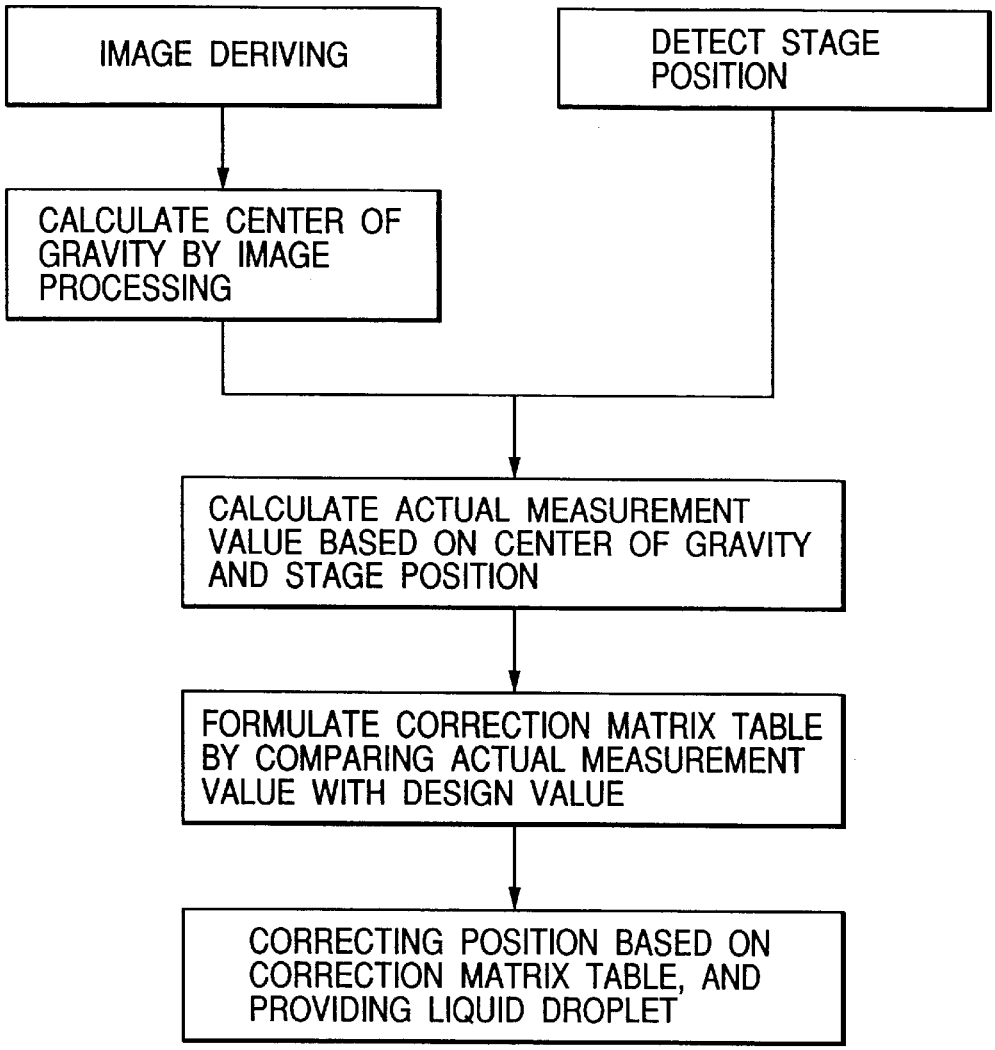
FIG. 20 is a flowchart for explaining a method according to the present invention for correcting a location at which a liquid droplet is to be deposited.

According to the present invention, the above shortcomings are resolved by the following processing. The processing will be described while referring to FIGS. 5A to 5C. FIG. 20 is a flowchart for this processing.

1. As well as in FIG. 4C, the CCD camera unit 7 obtained images at the individual elements of the electron source substrate that were fabricated with their locations shifted away from the design values. The image processing device extracted, from the obtained images, images at the element electrodes that were exposed on the substrate. In this embodiment, the obtained images were digitized to extract such images (FIG. 5A).

2. The computer 19 calculated the target coating position (measurement value) by using the center of gravity 27 of the liquid droplet provision pattern 27 that was obtained by means of the image processing, and the positional information that was obtained for the stage 15 by the position detecting mechanism 16. Subsequently, the computer 19 compared the measurement value with the design value and prepared the correction matrix table 28 (FIG. 5B).

3. The stage 15, in which the XY direction scanning mechanism is mounted, and the ink jet control and drive mechanism 18 were synchronously driven to deposit a liquid droplet 9. The value obtained from the correction matrix table 28 in FIG. 5B was transmitted to the position correction mechanism 17, and the head alignment mechanism 12 was driven in accordance with the value. Then, the position at which the liquid droplet 9 was to be applied could be adjusted, and the thin conductive film 4 could be formed at the optimal position for each electron emitting element.

Four liquid droplets 9 were applied to form the thin conductive film. The liquid droplet solution was an aqueous solution that contained a 0.2% palladium acetate-ethanolamine complex, 15% isopropyl alcohol, 1% ethylene glycol, and 0.05 polyvinyl alcohol. The substrate coated with the liquid was heated at 350° C. for 10 minutes. A particulate film 100 Å thick, which consisted of palladium oxide (PBO), was formed as the thin conductive film 4.

Furthermore, a voltage was applied between the element electrodes 2 and 3, and electroforming was performed for the thin conductive film 4 to form the electron emitting portion 5 in the thin conductive film 4. Sequentially, the activation process and the stabilization process were performed for the resultant structure to obtain the electron source substrate.

The external frame container 128 was constituted by the thus obtained electron source substrate, the face plate 126, the support 122 and the rear plate 121, as is shown in FIG. 12, and was sealed to provide the display panel. Further, a image forming apparatus was obtained that included the drive circuit shown in FIG. 14 that provides a television display in accordance with an NTSC signal.

In the electron source substrate that was fabricated using the method in this embodiment, the thin conductive film was satisfactorily formed on the substrate with only a slight variance, even though there was manufacturing variances in the widths and the locations of the wirings and the insulating layer that were formed by screen printing. In addition, the image forming apparatus could be obtained, with an excellent yield, that had only a slight variance in the element characteristic, as occurs when there are no manufacturing variances in the widths and the locations of the wirings and the insulating layer.

Embodiment 2

While referring to FIGS. 6A to 6C, an explanation will be given for a method for manufacturing an image forming apparatus that comprises the electron source substrate that is obtained by the fabrication method of the present invention. In this embodiment, the image forming apparatus was manufactured in the same manner as in the first embodiment, except that the element electrodes 2 and 3 were fabricated by coating the substrate with liquid droplets that contain the material used to form the element electrodes.

In this embodiment, since photolithography is not employed to form the element electrodes, the electron source substrate can be provided at a lower cost. However, liquid droplets that form the thin conductive film can not be adequately applied to the substrate because the positions and the shapes of the element electrodes differ from those that correspond to the design values. Therefore, the liquid droplet provision device of the present invention is employed so that the thin conductive film can be formed at a desired position on any type of substrate. The thus obtained substrate, the face plate 128, the support frame 122 and the rear plate 121 were used to constitute the external frame container 128 in the same manner as in the first embodiment. The container 128 was sealed to obtain the display panel.

Thus an image forming apparatus could be produced comprising the display panel and the drive circuit shown in FIG. 14 and that provided a television display in accordance with an NTSC signal. As a result, a preferable image forming apparatus, as in the first embodiment, could be obtained. According to the present invention, the image forming apparatus could be manufactured at a lower cost.

Embodiment 3

The electron source substrate and the image forming apparatus were manufactured in the same manner as in the first embodiment, except that, as is shown in FIG. 7A, the boundary in a specific direction was detected in the image processing to obtain the position of the center of gravity of a liquid droplet provision pattern.

Since the shape of an area of the electron source substrate where the thin conductive film is to be formed is generally rectangular, the side in the X or the Y direction that is longer than the other tends to be formed as designed. In this embodiment, therefore, the differential process was performed for images of the individual elements, and the boundaries were calculated in the direction for which high positioning accuracy was requested. The positional information concerning the center location between the boundaries was employed to prepare a correction matrix table 28 for only one direction (FIG. 7B). Based on the values in the table 28, the thin conductive film could be formed at a desired location in the same manner as in the first embodiment. The obtained electron source substrate, the face plate 126, the support frame 122, and the rear plate 121 were used as in the first embodiment to constitute the external frame container 128. The external frame container 128 was sealed to provide the display panel. As a result, an image forming apparatus was produced comprising the display panel and the drive circuit shown in FIG. 14 that provides a television display in accordance with an NTSC signal. A preferable image forming apparatus, as in the first embodiment, could be obtained.

According to this embodiment, since the correction matrix table 28 can be prepared either for the X or for Y direction, the time required for the preparation of the correction matrix table could be reduced, and the structure of the apparatus could be simplified.

Embodiment 4

In the image processing for detecting the position of the center of gravity of the liquid droplet provision pattern, images of the insulating layer and the wirings were extracted, and the shifting away from the design values were calculated using the image processing to facilitate the preparation of the correction matrix table 28. Then, the electron source substrate and the image forming apparatus were manufactured in the same manner as in the first embodiment.

As described in the first embodiment, for the electron source substrate used in the present invention, the element electrodes 2 and 3 were formed on the insulating substrate by photolithography, and the wirings and the insulating layer were formed by screen printing, which has a lower accuracy than has photolithography. Therefore, while the element electrodes 2 and 3 were formed substantially as designed, the wirings 82 and 83 and the insulating layer 41 tended to be shifted in the X, Y and θ directions because their locations were not aligned during the manufacturing process.

In this embodiment, therefore, the images of the wirings 82 and 83 and the insulating layer 41 on the electron source substrate were fetched by the CCD camera unit 7 (FIG. 19A). The image processing device obtained the position at the center of gravity of the liquid droplet provision pattern. The computer 19 calculated the target coating position (measurement value) by using the position at the center of gravity and the positional information that was obtained for the stage 15 by the position detecting mechanism 16.

The computer 19 compared the measurement value with the design value to prepare the correction matrix table 28 that was is used to correct the shifting in the X, Y and θ directions (FIG. 19B).

Based on the value in the table 28, the thin conductive film could be formed at a desired position in the same manner as in the first embodiment. The obtained electron source substrate, the face plate 126, the support frame 122 and the rear plate 121 were used in the same manner as in the first embodiment to constitute the external frame container 128. The external frame container 128 was sealed to provide the display panel. As a result, an image forming apparatus was produced comprising the display panel and the drive circuit shown in FIG. 14 that provided a television display in accordance with an NTSC signal. A preferable image forming apparatus, as in the first embodiment, could be obtained.

According to this embodiment, since the images for all the electron emitting elements on the substrate need not be fetched, the time required for the preparation of the correction matrix table can be considerably reduced.

As is described above, according to the methods used by the individual embodiments to fabricate the electron source substrate, an adequate correction for the location at which a droplet of a solution for forming a thin conductive film is to be provided can be provided, even when the widths and locations of the wirings and the insulating layer are varied because of screen printing, and they are not located at predetermined intervals. Therefore, a liquid droplet does not contact the wirings and the insulating layer, and the thin conductive film can be stably formed with a satisfactory yield. As a result, the electron source substrate having a large area and the image forming apparatus can be easily manufactured at a low cost.

Embodiment 5

In a fifth embodiment, an explanation will be given for an example wherein positional information is interpolated.

Step 1

The substrate 81 is washed thoroughly using pure water and an organic solvent, and a conductive material is applied thereto by vacuum deposition or sputtering. Then, the element electrode 2 and 3 and the wirings 82 and 83 are formed on the substrate 81 using, for example, photolithography.

Step 2

A droplet 9 of a solution that contains the material for forming the conductive film is ejected onto a predetermined position by the ejection head unit 6, and a conductive film is formed to connect the element electrodes 2 and 3. This process will be described as follows.

The CCD camera unit 7, the image processing device 14 and the XY scanning mechanism 15 are employed to detect the optimal location at which a liquid droplet is to be provided for an electron emitting element at a specific position. An arbitrary number of positions for the electron emitting elements on the substrate may be detected, so long as those positions adequately serve as means for obtaining optimal locations for the other elements at which liquid droplets are to be provided, and an arbitrary position for a specific element may be employed.

According to a specific method in this embodiment, nine points that consist of four points at the four corners of the substrate and midpoints between the four points are employed to detect the optimal liquid provision location of a specific element. The optimal liquid provision location of a specific element that is located among the nine points is calculated by interpolating the nine points using an appropriate curve.

The number of electron emitting elements to calculate the shape of a curve for interpolation and the positional information required for the interpolation can be changed as needed depending on the substrate, so that the yield can be improved. In this embodiment, the position of a specific element at which a liquid droplet is to be provided is obtained by interpolating the previously described nine points using the linear line.

Then, the ejection head unit 6 is moved relative to the substrate in accordance with the liquid provision locations of the individual elements, or the timings for application of liquid droplets 9 are corrected, and the liquid droplets 9 are applied at desired locations on the substrate 81.

The image processing device 14 can be a device for calculating the center of gravity of an image obtained by digitizing an image within a constant range, a device for performing differential calculations for an image within a specific range and for extracting the outline of a member to calculate a predetermined position, or a device for matching a pattern with an ideal image to calculate a predetermined position. A device that is available on the market can implement the above image processing.

The substrate 81 is heated to 300 to 400° C. to burn the liquid droplets 9, and the thin conductive film 4 is formed.

Step 3

Electroforming is performed for the resultant substrate 81. When a current is supplied to the element electrodes 2 and 3, the electron emitting portion 5 is formed at the location of the conductive film 4.

In the electroforming process, momentarily thermal energy is concentrated locally on one part of the thin conductive film 4, and an electron emitting portion 5 having an altered structure is formed at that location.

Figure 21:
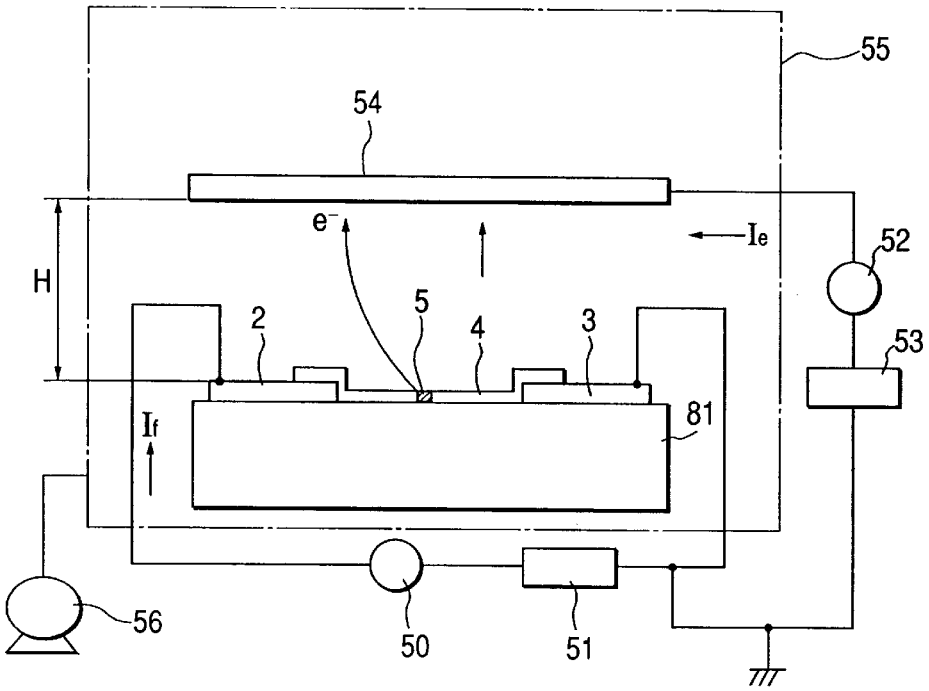
FIG. 21 is a schematic diagram illustrating an example vacuum processing device (measurement evaluation device) that can be employed to fabricate an electron emitting element according to the present invention.

The electric processing after electroforming can be performed by a vacuum processing device shown in FIG. 21, for example. The vacuum processing device also serves as a measurement evaluation device. In FIG. 21, the same reference numerals as are used in FIG. 1 are used to denote corresponding components.

The vacuum processing device in FIG. 21 comprises: a vacuum container 55, in which electron emitting elements are arranged; a vacuum pump 56; a power source 51, for applying an element voltage $V_f$ to the electron emitting elements; an ammeter 50, for measuring an element current $I_f$ that flows across the element electrodes 2 and 3; an anode electrode 54, for capturing an emitting current $I_e$ that is emitted by the electron emitting portion 5 of the element; a high voltage power source 53, for applying a voltage to the anode electrode 54; and an ammeter 52, for measuring an emitted current $I_e$ that is emitted by the electron emitting portion 5. As an example, a measurement is performed while the voltage of the anode electrode 54 is between 1 kV to 10 kV, and a distance H between the anode electrode 54 and each electron emitting element is 2 mm to 8 mm.

Devices, such as a vacuum gage, that are required to obtain a measurement in a vacuum are provided in the vacuum container 55, so that a measurement obtained in a desired vacuum atmosphere can be evaluated.

The vacuum pump 56 is constituted by a common high vacuum system, such as a turbo pump or a rotary pump, and a super high vacuum system, such as an ion pump. The overall vacuum processing device for which the electron emitting substrate is provided can be heated by a heater (not shown).

Step 4

It is preferable that the activation process be performed for the electron emitting element for which electroforming has been completed.

In the activation process, as well as in the electroforming process, a pulse can be repeatedly applied to the element electrodes 2 and 3 in an atmosphere containing an organic gas. Through this processing, the element current $I_f$ and the discharge current $I_e$ are changed drastically.

The atmosphere containing the organic gas during the activation process can be formed by using an organic gas that remains in the atmosphere after air has been evacuated from the vacuum container employing, for example, an oil diffusion pump or a rotary pump. This atmosphere can also be obtained by introducing a proper organic gas into a container from which air has been fully evacuated using an ion pump that does not employ oil. A preferable pressure is selected as needed for the organic gas, because it differs depending on the form of the element, the shape of the vacuum container and the type of organic material. A adequate organic material can be an aliphatic hydrocarbon, such as alkane, alkene or alkyne; an aromatic hydrocarbon; alcohol; aldehyde; ketone; amine; phenol; or an organic acid, such as phenol, carboxylic acid or sulfonic acid. Specifically, a saturated hydrocarbon can be used, such as methane, ethane or propane, that is represented by a composition of $C_nH_{2n+2}$; unsaturated hydrocarbon, such as ethylene or propylene, that is represented by a composition of $C_nH_{2n}$; benzene; toluene; methanol; ethanol; formaldehyde; acetaldehyde; acetone; methyl ethyl ketone; methylamine; ethylamine; phenol; formic acid; acetic acid; or propione.

Through the activation process, from the organic material that is present in the atmosphere, carbon or a carbon compound is deposited on the element and the element current $I_f$ and the discharge current $I_e$ are changed drastically.

The carbon or carbon compound is, for example, graphite (containing so called HOPG, PG or GC. HOPG has a substantially complete graphite crystal structure, PG has crystal particles of approximately 20 nm and a slightly disturbed crystal structure, and GC has crystal particles of approximately 2 nm and has a more disturbed crystal structure), or non-crystalline carbon (amorphous carbon and a mixture of amorphous carbon and minute crystal of the above graphite). The thickness of the deposited material is preferably equal to or less than 50 nm, and more preferably equal to or less than 30 nm.

Whether or not the activation process is completed can be determined as needed by measuring the element current $I_f$ and the discharge current $I_e$.

The thus obtained electron emitting element should be driven in an atmosphere having a higher degree of vacuum than that employed for the electroforming process and the activation process. It is more preferable that the electron emitting element be heated to 80 to 150° C. and be driven in an atmosphere having a higher degree of vacuum. The degree of vacuum that is higher than that in the electroforming process and the activation process is higher than that obtained, for example, at a pressure of $1.3\times10^{-4}$ Pa. More preferably, it is a super high vacuum in which almost no carbon or carbon oxide is deposited on the conductive film. As a result, the element-current $I_f$ and the discharge current $I_e$ can be stabilized.

While referring to FIG. 22, an explanation will now be given for the basic characteristic of the thus obtained electron emitting element that is employed for the present invention.

Figure 22:
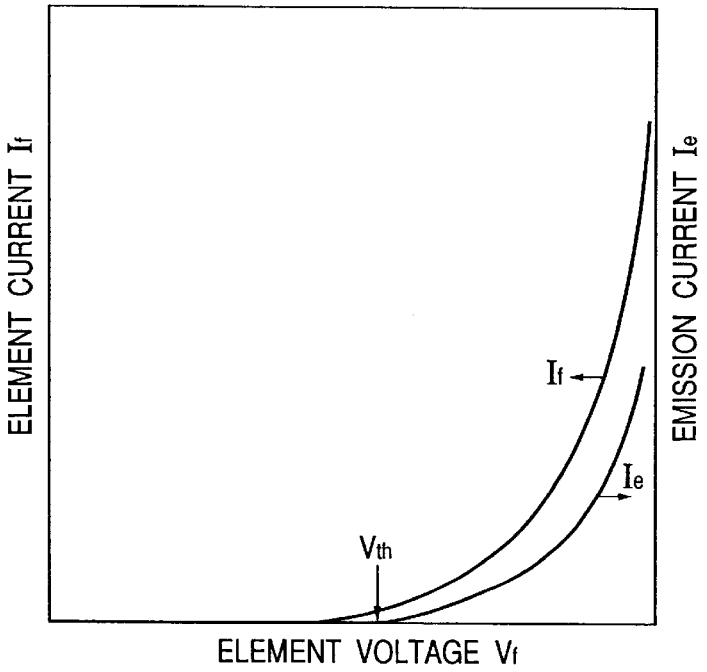
FIG. 22 is a graph showing the electron emitting characteristic of the electron emitting element according to the present invention.

FIG. 22 is a graph specifically showing the relationship between the discharge current $I_e$ and the element current $I_f$, which are measured by the vacuum device in FIG. 21, and the element voltage $V_f$. In FIG. 22, since the discharge current $I_e$ is considerably lower than the element current $I_f$, it is indicated by using an arbitrary unit. The linear scale is employed for the vertical and the horizontal axes.

As is apparent from FIG. 22, the electron emitting element according to the present invention has the three following characteristics relative to the discharge current $I_e$.

(i) When a voltage equal to or higher than a specific level (hereinafter called a threshold voltage, which is $V_{th}$ in FIG. 22) is applied to the electron emitting element, the discharge current $I_e$ is increased drastically. When a voltage lower than the threshold voltage $V_{th}$ is applied, almost no discharge current $I_e$ is detected. That is, the electron emitting element of the present invention is a non-linear element that has a precise threshold voltage $V_{th}$ for the discharge current $I_e$.

(ii) Since the discharge current $I_e$ is monotonically increased in accordance with the element voltage $V_f$, the discharge current $I_e$ can be controlled by using the element voltage $V_f$.

(iii) An electric charge that is captured by the anode electrode 54 (see FIG. 21) depends on the time of the application of the element voltage $V_f$. That is, the amount of charges captured by the anode electrode 54 can be controlled using the time at which the element voltage $V_{th}$ was applied.

As is apparent from the above description, the electron emitting characteristic of the electron emitting element of the present invention can be easily controlled in accordance with an input signal. By utilizing this characteristic, the present invention can be employed for various applications, such as an electron source or an image forming apparatus in which a plurality of electron emitting elements are arranged.

In FIG. 22, the element current $I_f$ is monotonically increased upon the application of the element voltage $V_f$(MI characteristic). However, the element current $I_f$ may indicate the voltage control negative resistance characteristic (VCNR) for the element voltage $V_f$ (not shown). These characteristics can be controlled by adjusting the procedures performed at above described steps.

An explanation will now be given for the arrangement of the fifth embodiment.

In this embodiment, the ejection head unit 6 is fixed to the main body of the liquid droplet provision device. The XY direction scanning mechanism 15 moves the substrate 81 to an arbitrary position, so that the ejection head unit 6 and the substrate 81 can be relatively displaced.

Images obtained by the CCD camera unit 7 are transmitted to the image processing device 14, which in turn processes the images. As a result, an optimal position can be detected at which the liquid droplet 9 is to be applied to a designated electron emitting element. Various methods can be used to detect the optimal position. In this embodiment, the images of the element electrodes 2 and 3 of a specific electron emitting element are fetched, and the contrasting images are digitized. The position at the center of gravity of the specific digital contrasting portion is calculated. At this time, the image expansion and reduction process or an image embedding process may be additionally performed for the digital image, in order to improve the accuracy of the digital image.

An image processing device CS-902, produced by Fast Corp., is employed as the image processing device 14; however, another image processing that can implement the desired image processing may be employed.

The image information obtained by the image processing device 14 and the positional information that is obtained for the stage 15 by the position detecting mechanism 16 are employed to acquire positional information for a specific electron emitting element on the substrate 81 on the stage 15. This positional information is transmitted to the computer 19.

While referring to FIGS. 23A to 26, an explanation will be given for a method for fabricating an electron source for the embodiment wherein the above described device is employed.

Figure 23A:
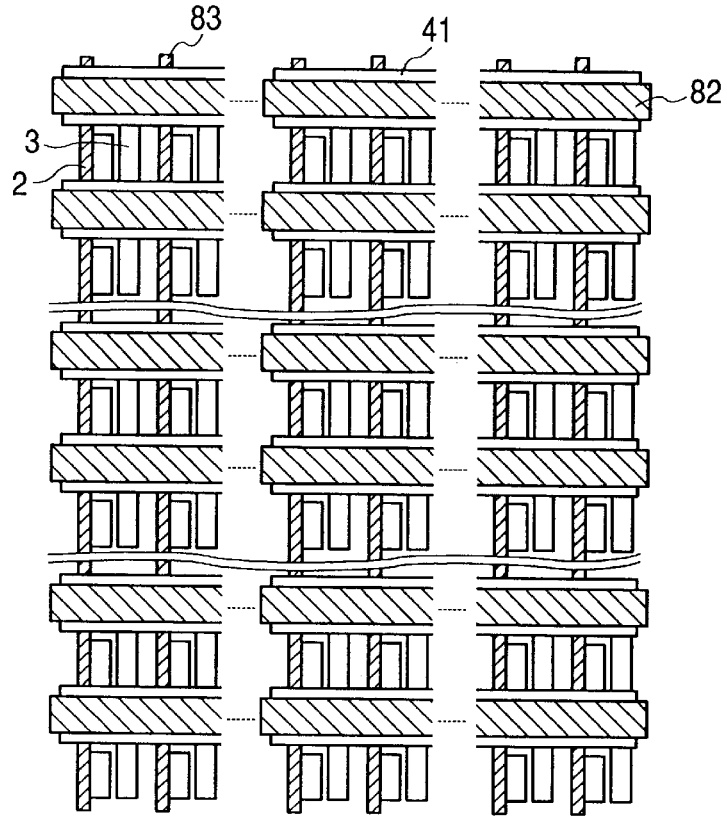
FIGS. 23A and 23B are specific diagrams showing the state wherein liquid droplets are applied to element electrodes according to a fifth embodiment of the present invention.
Figure 23B:
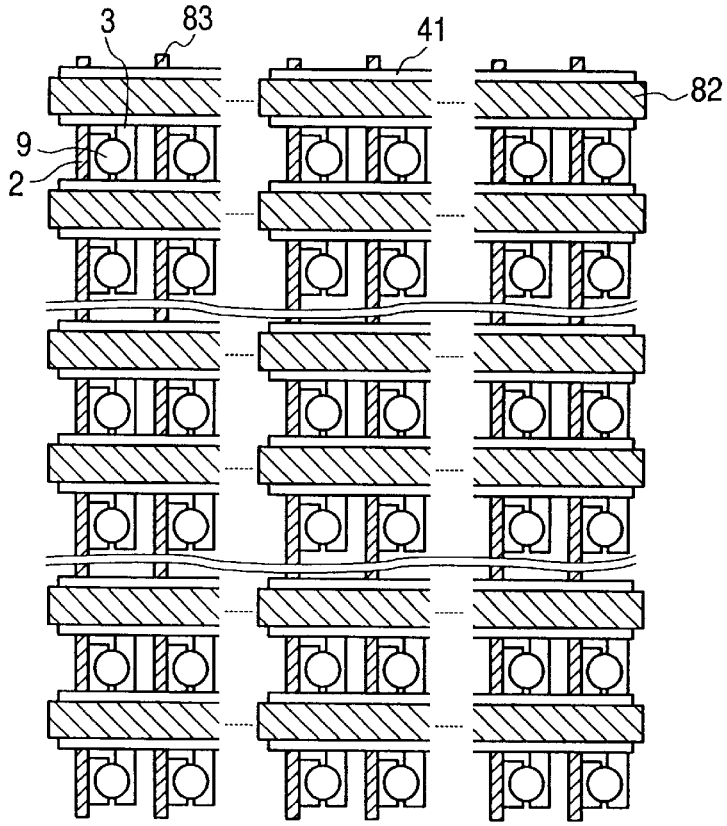
Figure 24A:
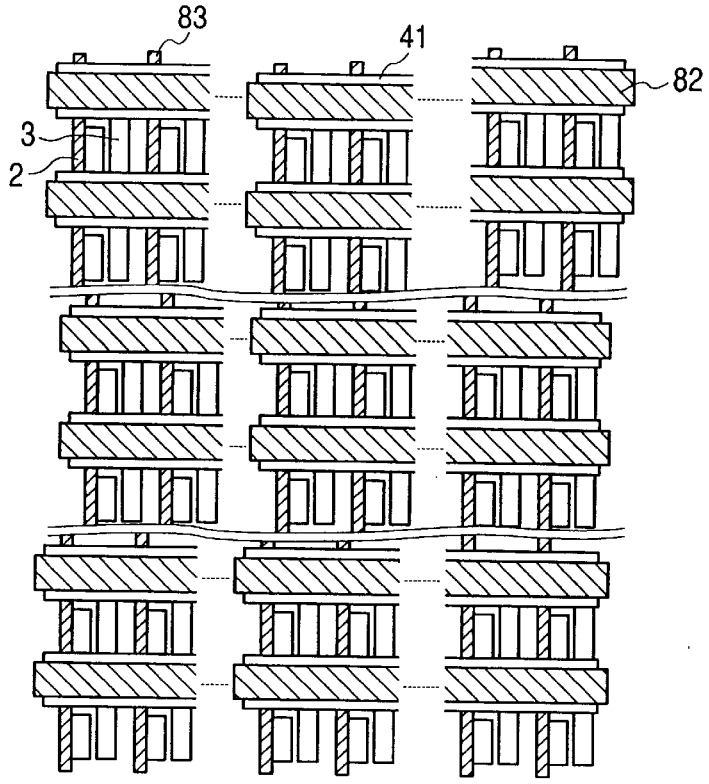
FIGS. 24A and 24B are specific diagrams showing the state wherein liquid droplets are applied to the element electrodes according to the fifth embodiment.
Figure 24B:
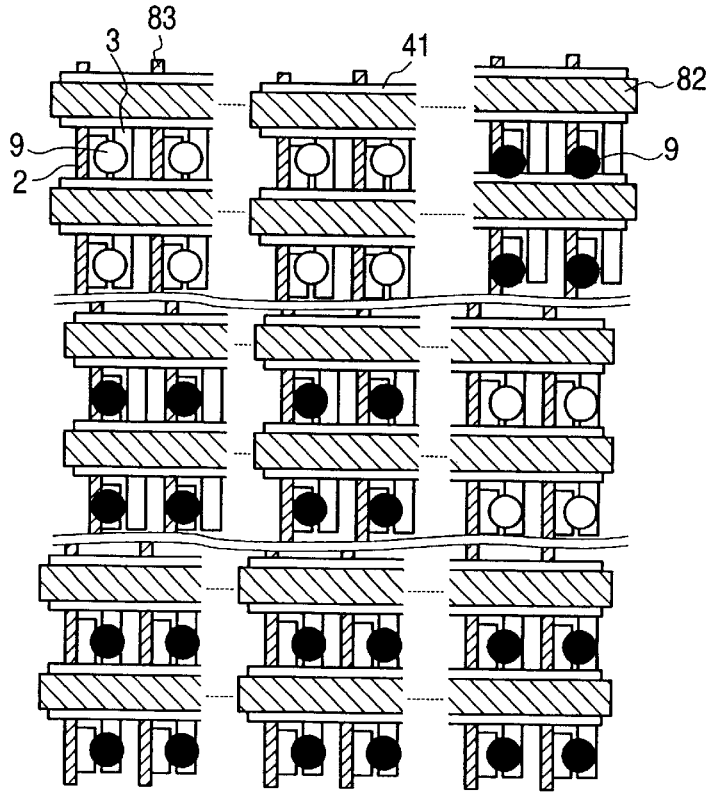

In FIGS. 23A and 23B is shown an example wherein the element electrodes 2 and 3 and the wirings 82 and 83 are formed as designed. In FIGS. 24A and 24B is shown an example (substantially, an actual case) wherein these components are formed after being shifted away from the design values. In these referenced examples are shown the states wherein liquid droplets are provided at the element electrodes 2 and 3.

Figure 25A:
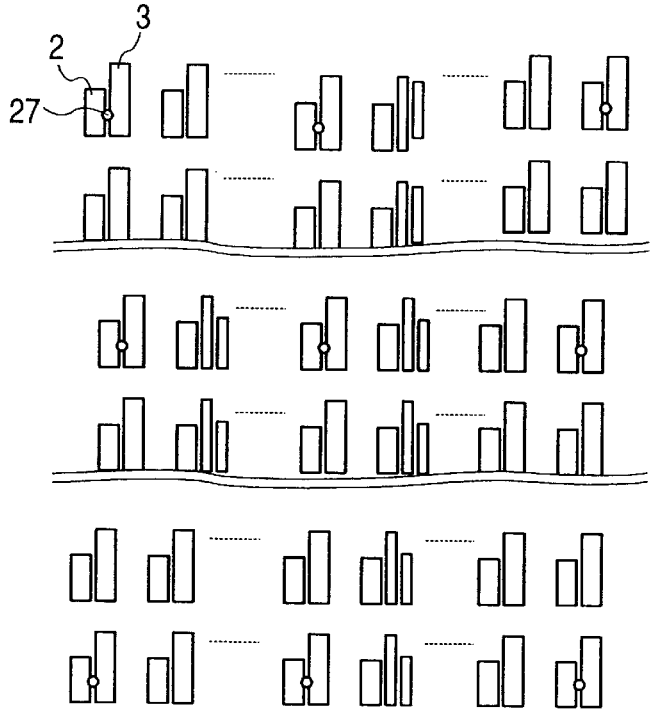
FIGS. 25A and 25B are specific diagrams showing a method for depositing liquid droplets according to the fifth embodiment.
Figure 25B:
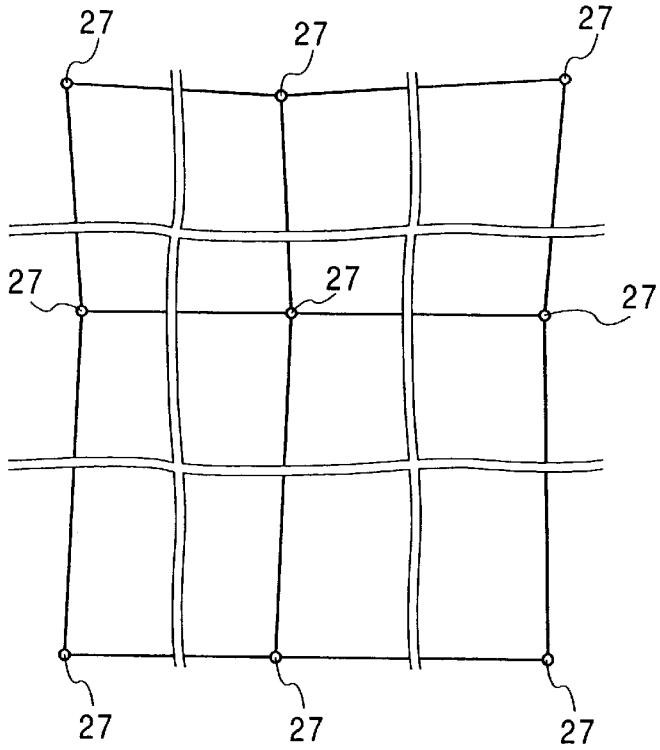
Figure 26:
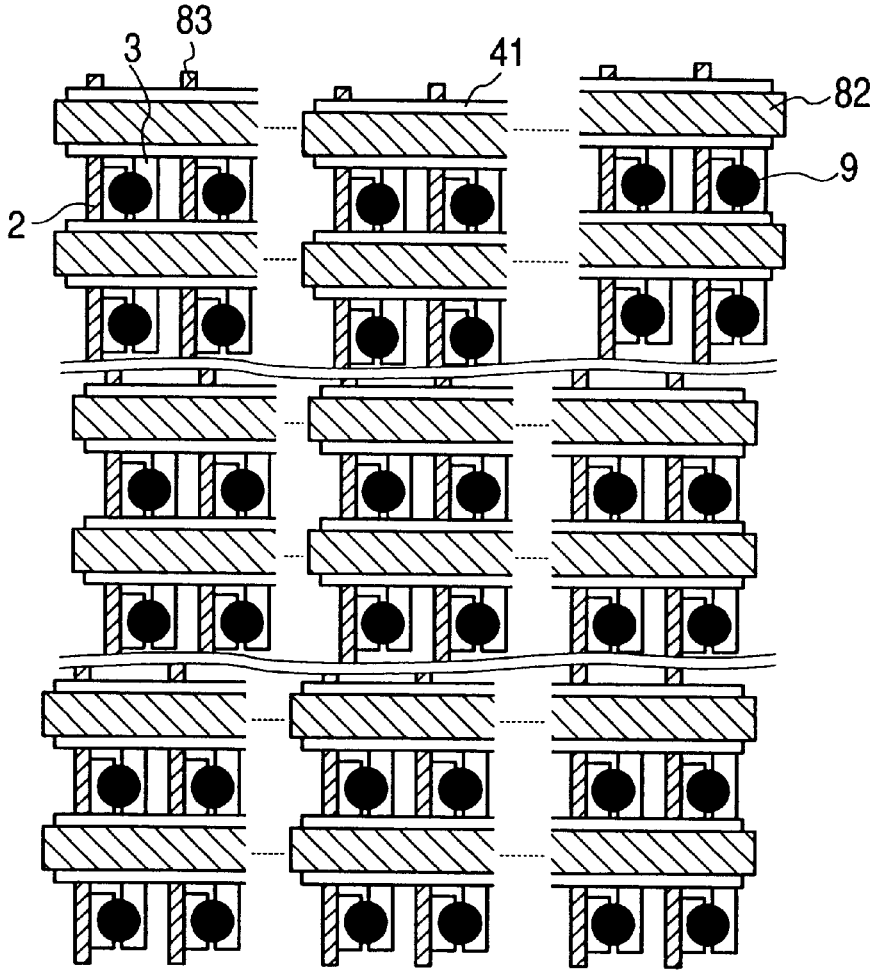
FIG. 26 is a specific diagram showing liquid droplets that are deposited according to the fifth embodiment.

FIGS. 25A and 25B are specific diagrams illustrating a liquid droplet provision method employed by the device of the present invention. In FIG. 25A is shown the optimal liquid provision position of an electron emitting element at a specific location 27 that is read by measuring the image. FIG. 25B is a topological diagram for employing the optimal position information for the element at the location 27 to obtain the liquid provision positions of all the electron emitting elements on the substrate 81. In FIG. 26 is shown a liquid droplet that is provided according to this embodiment based on the topological diagram in FIG. 25B.

Step a

A soda lime glass was employed as the substrate 81. The substrate 81 was washed thoroughly using an organic solvent, and was dried at 120° C. A plurality of pairs of element electrodes 2 and 3 were formed of Pt at a gap interval of 20 $\mu$m on the substrate 81 by vacuum film formation and photolithography. Then, the X directional wirings 82, the Y directional wirings 83 and the insulating layers 41 were formed by screen printing in order to apply a voltage to the element electrodes 2 and 3. These wirings were arranged as a matrix.

If the element electrodes 2 and 3 can be formed as designed (FIG. 23A), the locations at which the electron emitting portions are to be formed are determined at a predetermined interval relative to a reference location on the substrate. The XY direction scanning mechanism that moves the substrate 81 is driven at a constant speed, and synchronously, at a predetermined time interval, the ink jet head control and drive mechanism 8 ejects liquid droplets 9. Thus, the liquid can be easily applied to the substrate 81 (FIG. 23B).

However, in actuality, since the substrate 81 must be heated to over 300° C. during the screen printing process, the substrate 81 would be thermally deformed and the individual portions of the substrate would tend to be formed in shapes that differ from those in the design. In particular, the thermal distortion quantity are different inside a substrate and between substrates. If a liquid droplet 9 is applied in the same manner as is specified by the design values, it contacts the insulating layer 4 or the wirings 82 and 83 and is absorbed, so that a desired conductive film can not be formed. This renders the resultant substrate defective and it can not serve as an electron source substrate (FIG. 24B). The yield obtained by the above described liquid provision method is equal to or lower than 10%.

Step b

Figure 27:
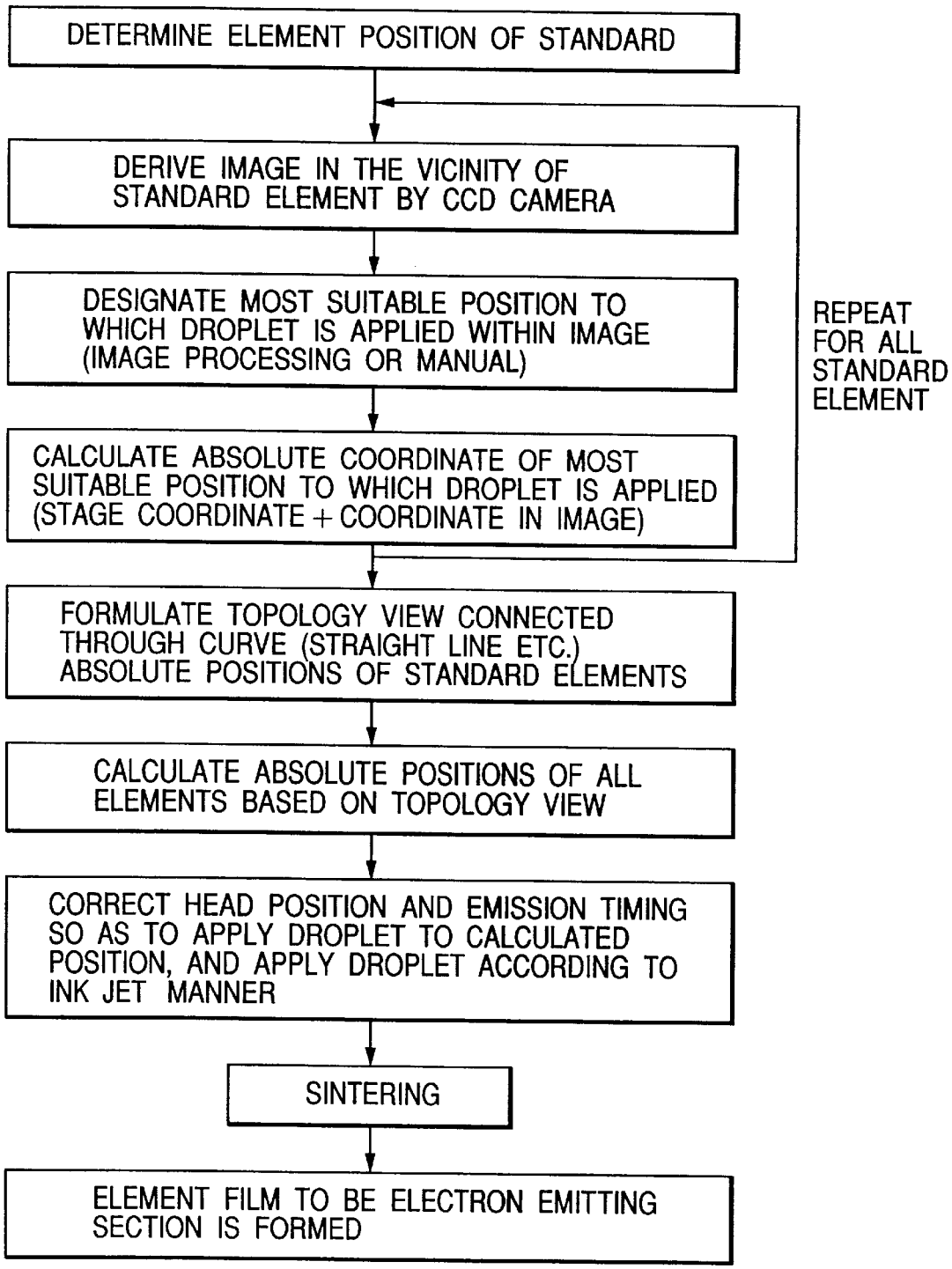
FIG. 27 is a flowchart showing the processing for forming a conductive film according to the fifth embodiment.

In this embodiment, the above shortcomings are resolved by performing the following procedures 1 to 4. These steps will now be described while referring to FIGS. 25A to 26 and the flowchart in FIG. 27.

Procedure 1

Assume that, as is shown in FIG. 24A, electron emitting elements are formed on the substrate while their locations are shifted away the designed values. First, the absolute coordinates of a position at which a liquid droplet for forming a conductive film is to be provided is calculated for an electron emitting element that is to be formed at a designated coordinate location on the substrate. While various methods are available by which to calculate the absolute coordinates, in this embodiment the coordinates are calculated as follows.

First, the stage 15 on which the substrate 81 is mounted is moved, and the periphery of an element that is located at a designated coordinate position is viewed by the CCD camera unit 7. At this time, the relationship between the absolute position of the stage 15 and the positions of individual pixels obtained by the CCD camera unit 7 must be obtained.

The absolute coordinate position at which the liquid droplet 9 is to be applied is determined by using an image that is obtained by the CCD camera unit 7. The following methods can be employed to determine the absolute coordinates: (1) a method for manually providing pixel coordinates to the CCD camera unit 7 that constitute a target position and for calculating the absolute coordinates for the target position using the pixel coordinates and the position of the stage 15; and (2) a method for digitizing an image in the vicinity of the electron emitting element, to extract the location of the element electrode, by employing the center of the gap as the target position in the X direction and by employing the center of the extracted image as the target position in the Y direction, and by employing the pixel coordinates to calculate the absolute coordinates for the target position in the same manner as in method (1).

Procedure 2

According to either method described in procedure 1, positional information is calculated concerning the designated position on the substrate 81. A satisfactory number of locations for the electron emitting elements, for which the positional information is to be obtained in procedures 1 and 2, must be required in order to obtain positional information for the other electron emitting elements by using a method which will be described later. As the number of electron emitting elements for which the positional information is to be obtained is increased, the positional information for the other elements can be easily acquired. However, if there are too many electron emitting elements for which the positional information must be obtained, the processing time is extended and the manufacturing cost is increased. In this embodiment, therefore, procedures 1 and 2 are performed for four points at the four corners of the substrate and elements at midpoints, i.e., a total of nine points (FIG. 25A).

Procedure 3

In accordance with the positional information obtained at procedures 1 and 2, a topological diagram is prepared wherein the adjacent elements are connected together by linear lines (FIG. 25B). Then, assuming that the other electron emitting elements on the substrate are located at positions represented in the topological diagram, the positional information for all the other electron emitting elements are obtained.

Procedure 4

The stage 15 and the ink jet control and drive mechanism 18 are synchronously driven to provide the liquid droplets 9 (FIG. 26). For the liquid provision, the positional information for all the elements obtained at procedure 3 are transmitted to the position correction device 17, and the head alignment mechanism 12 is driven in accordance with the positional information to correct the positions at which the liquid droplets 9 are to be applied. Therefore, the conductive film for forming the electron emitting portion can be applied at the optimal positions for all the elements.

In this embodiment, the liquid droplets 9 were applied four times. The substrate 81 was then heated to 300° C. for ten minutes, and a film consisting of particulates of palladium oxide (PdO) that was 100 Å thick was formed as the thin conductive film 4.

Step c

A voltage was applied to the element electrodes 2 and 3, and electroforming was performed for the thin conductive film 4 to fabricate the electron emitting portion 5.

As is shown in FIG. 12, the external frame container 128 was constituted by the thus fabricated electron source substrate, the face plate 126, the support frame 122 and the rear plate 121. The container 128 was sealed to form the display panel. as a result, an image forming apparatus was produced that includes the drive circuit shown in FIG. 14 for providing a television display in accordance with an NTSC signal.

The electron source that was fabricated using the method of the present invention demonstrated a preferable characteristic, and the desired conductive film could be uniformly formed on the substrate. In addition, according to the present invention, the yield that conventionally is lower than 10% was increased merely by adding a step of obtaining positional information for nine points and of linking these points as linear lines, which does not require a long processing time, and a preferable image forming apparatus could be obtained that substantially has as little variance in the element characteristic as have those obtained when the elements are fabricated using photolithography.

In this embodiment, the nine points, including the four corner points of the substrate, are employed as references to prepare the topological diagram in FIG. 25B. It is natural that as the number of points is increased, the degree to which the substrate is actually deformed can be precisely obtained. The number of nodes to prepare the topological diagram can be freely changed in accordance with the state of the deformation of the substrate, and is not limited to the number used in this embodiment. The fabrication device of the embodiment can cope with an arbitrary number of nodes.

Embodiment 6

While referring to FIGS. 28A to 29, an explanation will be given for a method for manufacturing an image forming apparatus having an electron source according to a sixth embodiment.

Figure 28A:
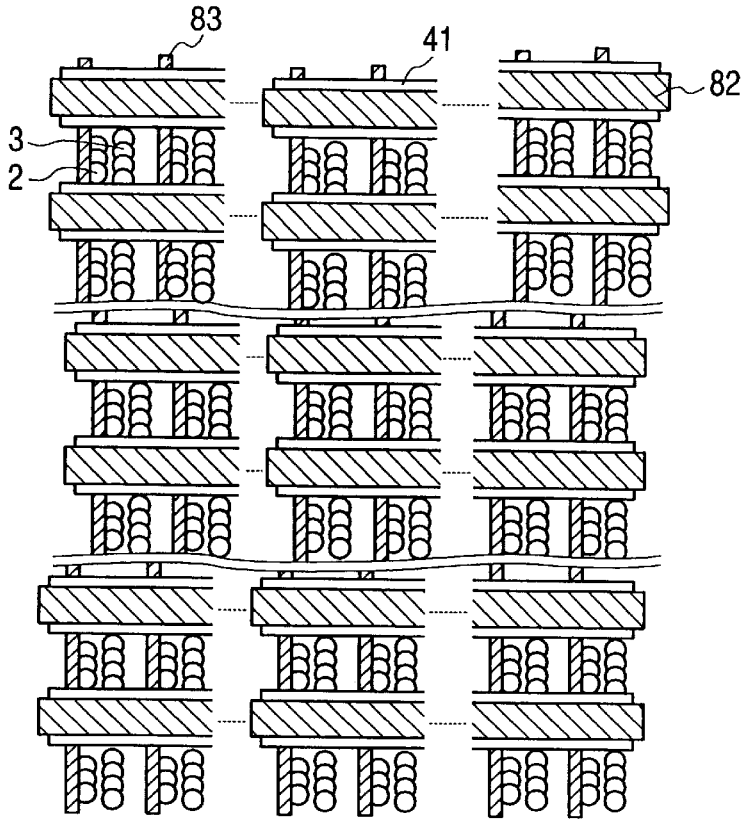
FIGS. 28A and 28B are diagrams showing a method for depositing liquid droplets according to a sixth embodiment of the present invention.
Figure 28B:
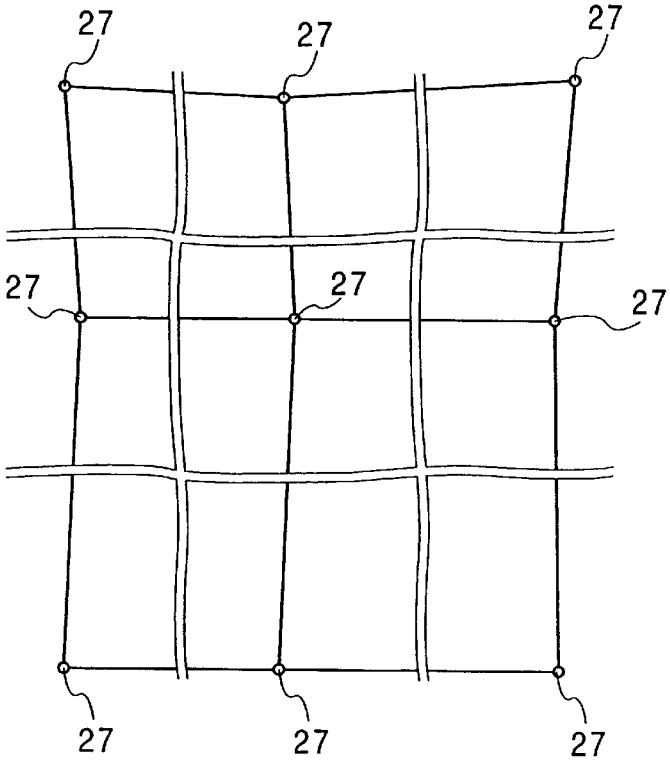
Figure 29:
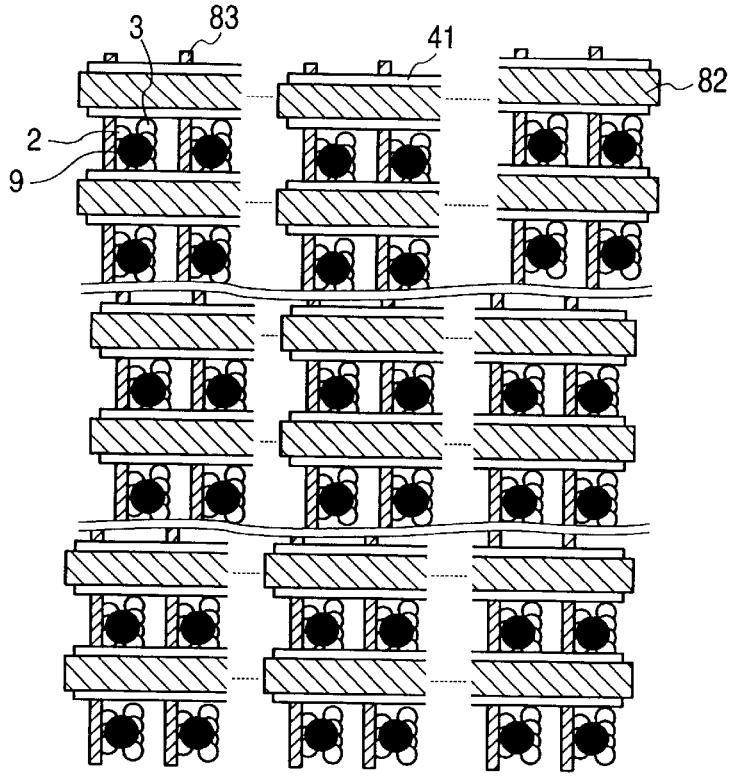
FIG. 29 is a specific diagram showing liquid droplets that have been deposited according to the sixth embodiment.

FIGS. 28A and 28B are specific diagrams illustrating a liquid provision method employed by the image forming apparatus. In FIG. 28A is shown the arrangement of the element electrodes that are formed by a liquid provision device. FIG. 28B is a topological diagram that was prepared in order to obtain the liquid provision positions of all the elements on the substrate 81 based on the optimal positional information for an element that was located at a specific position 27. In FIG. 29 are shown liquid droplets that were provided in accordance with the topological diagram in FIG. 28B.

The electron source in this embodiment was formed in the same manner as in the fifth embodiment, except that the element electrodes 2 and 3 were formed by applying to the substrate 81 liquid droplets that contained the material for forming element electrodes.

In this embodiment, since photolithography is not employed to form element electrodes, the electron source can be provided at a lower cost. However, since the positions and shapes of the element electrodes are shifted away from the design values, liquid droplets, which form the conductive film that provides the electron emitting portions, can not be satisfactorily applied. When the liquid provision device of the present invention is employed, however, the liquid droplets can be applied at desired locations on any type of substrate.

In the same manner as in the fifth embodiment, the external container 128 was constituted by the thus obtained electron source substrate, the face plate 126, the support frame 122 and the rear plate 121. The container 128 was sealed to obtain the display panel. Furthermore, an image forming apparatus could be produced that included the drive circuit in FIG. 14 for providing a television display in accordance with an NTSC signal.

As a result, a preferable image forming apparatus, as in the fifth embodiment, could be obtained at a low cost.

Embodiment 7

Figure 30:
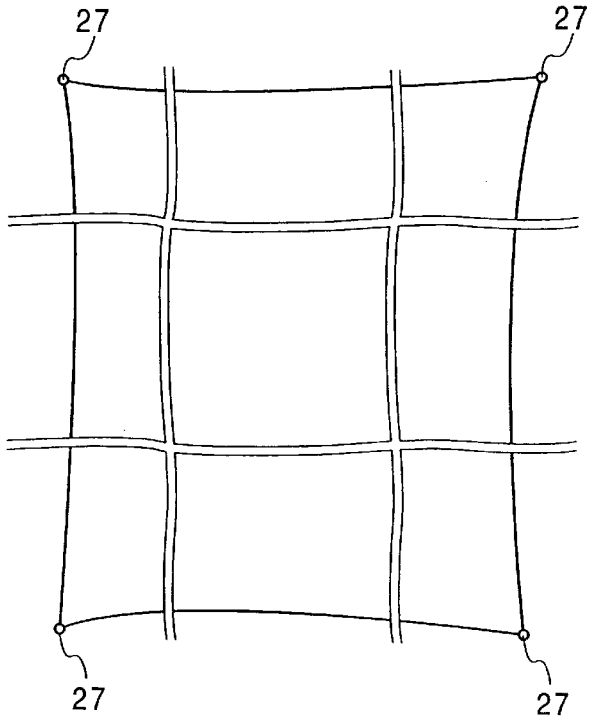
FIG. 30 is a topological diagram for explaining a method for depositing liquid droplets according to a seventh embodiment of the present invention.

A method for manufacturing an image forming apparatus that includes an electron source according to a seventh embodiment will now be described while referring to FIG. 30. FIG. 30 is a topological diagram that, based on the optimal positional information for an element that is located at a specific position 27, is prepared to obtain liquid provision positions for all the electron emitting elements on the electron source substrate.

This embodiment is substantially the same as the fifth embodiment, except that the topological diagram in FIG. 30 is prepared by employing quadratic curves to link the positions of the four corners of the substrate and the intervals between them.

When the deformation of the substrate is represented more effectively by using multiple-order curves, the linking of the nodes in the topological diagram is not necessary represented by linear lines. As in this embodiment, frequently, multiple-order curves can precisely represent the actual deformation of a substrate. In this embodiment, since the linking of the nodes is represented by quadratic curves, the number of points to be obtained in the image processing for the liquid provision positions of specific electron emitting elements is reduced, so that the processing time is shortened.

The method for preparing the topological diagram is discussed each time the method for fabricating the wirings and the other components is changed. Accordingly, yield can be further improved and a uniform element characteristic obtained.

Embodiment 8

Figure 31:
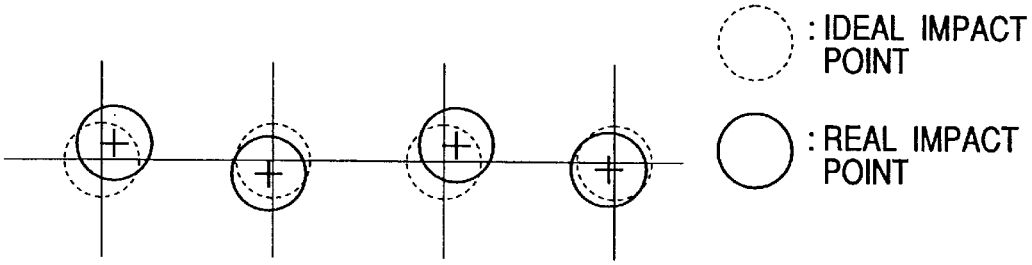
FIG. 31 is a diagram for explaining the correction of locations whereat liquid droplets are deposited according to an eighth embodiment of the present invention.

A method for manufacturing an image forming apparatus having an electron source according to an eighth embodiment will now be described while referring to FIGS. 31 to 33. In this embodiment, the method used for the fifth embodiment is employed, and to reduce the processing time a plurality of liquid droplets are simultaneously applied.

Figure 32:
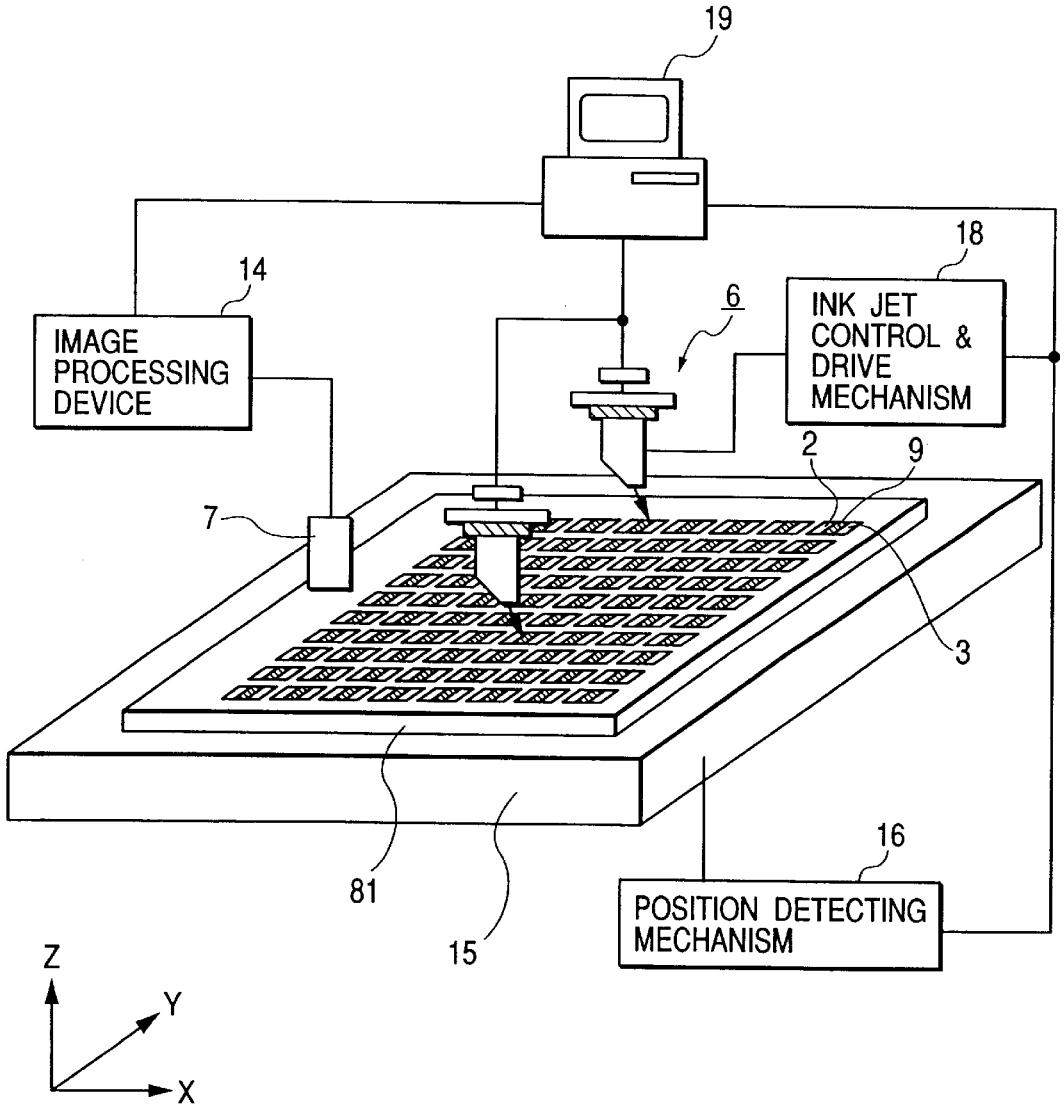
FIG. 32 is a diagram illustrating the arrangement of a liquid droplet depositing apparatus that is employed for fabricating an electron source according to the eighth embodiment.

FIG. 32 is a diagram illustrating the arrangement of a fabrication apparatus according to the eighth embodiment. An explanation will now be given for the arrangement of this apparatus and a method for fabricating an electron source substrate that employs this device.

The apparatus in FIG. 32 has substantially the same structure as that in the fifth embodiment. The apparatus includes a plurality of ejection head units 6 (two in FIG. 32) for simultaneously applying a plurality of liquid droplets 9. Each of the ejection head units 6 includes a plurality of nozzles, as shown in FIG. 33. The ink jet control and drive mechanism 18 permits the ejection of the liquid droplets 9 through the nozzles of the ejection head unit 6.

In this embodiment, as well as in the fifth embodiment, the liquid provision position can be corrected. However, since a plurality of nozzles are employed for one ejection head unit 6 and a plurality of head units 6 are used simultaneously, the liquid droplets 9 can not be provided at adequate positions merely by using the method employed in the fifth embodiment.

Therefore, in order to resolve this shortcoming, the following method is employed to calculate the locations at which the liquid droplets 9 are to be simultaneously applied, and to correct the positioning.

a) The nozzles of the ejection head unit 6 are selected so that the distance between them is the same pitch as is that for the arrangement of the electron emitting elements, or is integer times the distance of the element interval. These selected nozzles are regarded as those used for applying the liquid droplets 9.

Figure 33:
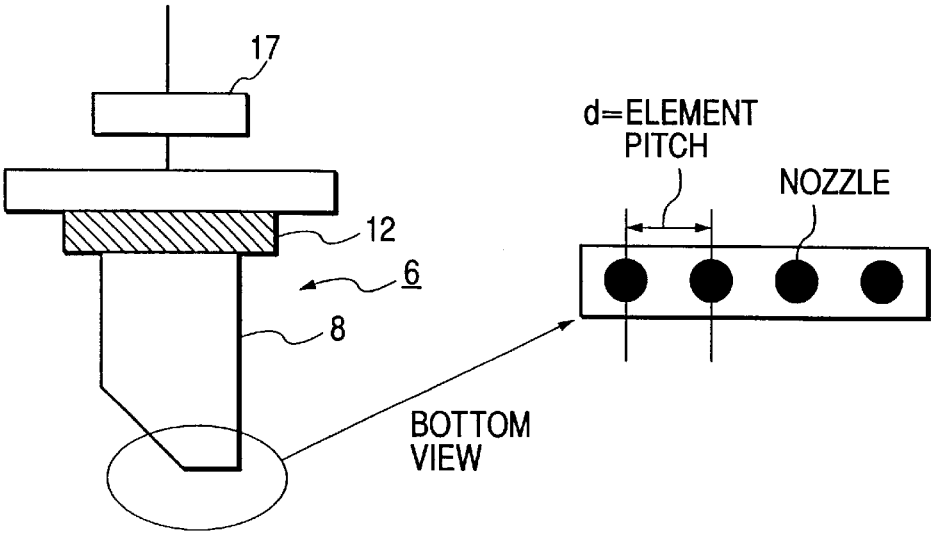
FIG. 33 is a diagram illustrating the arrangement of the ejection head unit of the liquid droplet depositing apparatus according to the eighth embodiment.

In this embodiment, the ejection head units 6 are designed so that nozzle pitch d provides the same interval as does the element pitch, and so that four nozzles are provided for one head unit 6 (see FIG. 33).

b) The liquid droplets 9 are ejected through the selected nozzles onto the portion outside the image area on the electron source substrate.

c) The positions at which the liquid droplets 9 were applied at b) are measured. Ideally, the liquid droplets 9 are supposed to be applied coaxially at the same interval as the nozzle pitch (=the pitch of the electron emitting elements). Actually, the liquid droplets 9 are applied to locations that are shifted away from the ideal positions because of an error occurring during the manufacture of the ejection head units 6, and differences in the ejection characteristics of the nozzles (see FIG. 31). Therefore, the distances to the ideal positions for the four nozzles are measured and the average is calculated.

d) The deformation of the substrate is calculated in the same manner as in the fifth embodiment, and a topological diagram required for correcting the positions is prepared.

e) While the positions are corrected based on the topological diagram prepared at d), the liquid droplets 9 are simultaneously applied through the selected nozzles in the ink jet heads to form on the substrate 81 a thin conductive films in which electron emitting portions are formed. At this time, the average shift away from the liquid provision position that is acquired at b) is added to the correction value, so that the liquid droplets can be simultaneously and uniformly applied at the target locations on the substrate 81.

Since with the above method a plurality of liquid droplets can be simultaneously applied to the substrate, the processing time can be considerably reduced.

In this embodiment, two ejection head units, each of which have four nozzles, are employed. However, the number of units and of nozzles is not thereby limited. However, for fabrication of the electron source substrate, it is necessary for the average shift away from the liquid provision location to not exceed a permissible range.

As is described above, according to the present invention, the conductive film can be stably formed, with a satisfactory yield, by providing liquid droplets without using photolithography. Therefore, compared with the conventional method, the number of procedures can be reduced and the manufacturing costs can be lowered. As a result, a large electron source in which are arranged multiple electron emitting elements can be easily provided at a low cost.

In addition, by employing such an electron source, a high quality image forming apparatus, such as a flat color television, is provided for which there is little bright-spot shifting and little luminance variance.

In the appended claims, independently calculating the X-Y coordinates of a plurality of locations means that coordinates of each individual location can vary in relation to other locations.

What is claimed is:

1. A method for forming a film locally on a substrate comprising the steps of:

detecting the state of said substrate;

employing the obtained result to independently calculate X-Y coordinates of a plurality of locations at which the material for said film is to be provided to form said film, said plurality of locations arranged in a dotted manner in each of a plurality of directions; and providing said material for said film at said plurality of locations based on said positional information that is obtained for said plurality of locations, wherein said step of providing said material for said film is performed after calculating the X-Y coordinates of each location in said plurality of locations in each of said plurality of directions.

2. A method according to claim 1, wherein said film is a conductive film.

3. A method according to claim 1, wherein said state of said substrate that is detected is the state of a portion wherein said material is to be provided, or an area in the vicinity of said portion.

4. A method according to claim 1, wherein said state of said substrate that is detected concerns image information for said substrate.

5. A method according to claim 1, wherein said state of said substrate that is detected concerns the arrangement of components on said substrate.

6. A method according to claim 1, wherein said state of said substrate that is detected concerns the arrangement of electrodes on said substrate.

7. A method according to claim 1, wherein said state of said substrate that is detected concerns the arrangement of wirings on said substrate.

8. A method for forming a film locally on a substrate comprising the steps of:

detecting the state of said substrate concerning the arrangement of an insulating layer on said substrate;

employing the obtained result to calculate in a surface plane direction of the substrate positional information concerning a plurality of locations at which the material for said film is to be provided to form said film; and providing said material for said film at said plurality of locations based on said positional information that is obtained for said plurality of locations, wherein said step of providing said material for said film is performed after calculating the positional information concerning a plurality of locations.

9. A method according to claim 1, wherein said state of said substrate that is detected concerns the arrangement of a common wiring to which a plurality of conductive films are electrically connected, or of a member that accompanies said common wiring.

10. A method according to claim 1, wherein said substrate is an insulating element.

11. A method according to claim 1, wherein the calculation of said positional information includes a calculation of information that concerns a location at which said material has to be provided.

12. A method according to claim 1, wherein said step of calculating said positional information for said locations includes a step of employing, to calculate positional information for each of said plurality of locations, said detected state of said substrate that concerns locations that are fewer in number than said plurality of locations.

13. A method according to claim 1, wherein said calculation of said positional information includes the calculation of a compensation value that is used to compensate for a control value for controlling said locations whereat said material is to be provided.

14. A method according to claim 13, wherein said compensation value is that used for compensating for a difference between said locations whereat said material has to be provided and locations whereat said material is to be provided when the compensation is not performed.

15. A method according to claim 1, wherein said material is provided in liquid form.

16. A method according to claim 1, wherein said material is an organic metal solution.

17. A method according to claim 1, wherein said material is provided as liquid droplets.

18. A method according to claim 1, wherein said material is provided by an ink-jet device.

19. A method according to claim 1, wherein said material is sequentially provided at said plurality of locations.

20. A method according to claim 1, wherein said material is provided at said plurality of locations by a same provision unit.

21. A method according to claim 1, wherein said material is provided at said plurality of locations by a plurality of provision units.

22. A method according to claim 1, wherein said material is sequentially provided at said plurality of locations while the relative locations of provision unit and said substrate are changed.

23. A method according to claim 1, wherein said material is sequentially provided at said plurality of locations at each of several locations for said plurality of locations.

24. A method according to claim 1,.wherein said plurality of locations are preferably arranged in columns or in rows.

25. A method according to claim 24, wherein an arrangement includes a plurality of columns or rows.

26. A method according to claim 1, further comprising a step of annealing said material that is provided.

27. A method for forming a film locally at a plurality of locations arranged in a dotted manner in each of a plurality of directions, there being at least six of said plurality of locations in each of said plurality of directions on a substrate comprising the steps of:

detecting the state of said substrate at least at six of said plurality of locations along each of said plurality of directions;

employing the obtained result to calculate in a surface plane direction of the substrate positional information concerning said plurality of locations at which the material for said film is to be provided to form said film; and providing said material for said film at said plurality of locations based on said positional information that is obtained for said plurality of locations, wherein said step of providing said material for said film is performed after calculating said positional information concerning each location in said plurality of locations in each of said plurality of directions.

28. A method for manufacturing an electron source including a plurality of electron emitting elements comprising the steps of:

locally forming, on a substrate, conductive films that at least partially constitute said electron emitting elements, said step including detecting the state of said substrate, employing the obtained results to independently calculate X-Y coordinates of a plurality of locations at which the material for said conductive films is to be provided to form said conductive films, said plurality of locations arranged in a dotted manner in each of a plurality of directions, and providing said material for said conductive films at said plurality of locations based on said X-Y coordinates; and forming an electron emitting portion in at least one part of each of said conductive films, wherein said step of providing said material for said film is performed after calculating the X-Y coordinates of each location in said plurality of locations in each of said plurality of directions.

29. A method according to claim 28, wherein said step of forming said electron emitting portion includes a step of electrifying said conductive films.

30. A method according to claim 28, wherein said electron emitting elements are electron emitting elements of a surface conductive type.

31. A method according to claim 28, wherein each said electron emitting element has a pair of element electrodes.

32. A method according to claim 31, wherein said material for said conductive film is provided between said element electrodes.

33. A method according to claim 31, wherein the positional information concerning a plurality of locations is calculated based on comparing a designed value with an actually measured value of said pair of element electrodes.

34. A method according to claim 31, wherein a state of arrangement of a structure on said substrate is detected during said detection step.

35. A method according to claim 28, wherein a state of arrangement of a structure on said substrate is detected during said detection step.

36. A method according to claim 35, wherein the detection of said arrangement of said structure on said substrate is performed based on an image information of said substrate.

37. A method according to claim 35, wherein said structure is an electrode.

38. A method according to claim 35, wherein said structure is a wiring.

39. A method for manufacturing an electron source including a plurality of electron emitting elements, comprising the steps of:

locally forming, on a substrate, conductive films that at least partially constitute said electron emitting elements, said step including detecting the state of said substrate, employing the obtained results to calculate positional information concerning a plurality of locations at which the material for said conductive films are to be provided to form said conductive films, and providing said material for said conductive films at said plurality of locations based on said positional information that is obtained; and forming an electron emitting portion in at least one part of each of said conductive films, wherein a state of arrangement of an insulating layer on said substrate is detected during said detection step.

40. A method according to claim 35, wherein said structure is a common wiring, electrically connected to said conductive film, or a member that accompanies said common wiring.

41. A method according to claim 28, wherein said material is provided as liquid droplets.

42. A method for manufacturing an electron source including a plurality of electron emitting elements comprising the steps of:

locally forming at a plurality of locations arranged in a dotted manner in each of a plurality of directions and located at least at six locations along each direction, on a substrate, conductive films that at least partially constitute said electron emitting elements, said step including:

detecting the state of said substrate at least at six of said plurality of locations along each of said plurality of directions, employing the obtained results to calculate positional information concerning said plurality of locations at which the material for said conductive films is to be provided to form said conductive films, and providing said material for said conductive films at said plurality of locations based on said positional information that is obtained; and forming an electron emitting portion in at least one part of each of said conductive films, wherein said step of providing said material for said film is performed after calculating the positional information concerning each location in said plurality of locations in each of said plurality of directions.

43. A method according to claim 28, wherein said material is provided by an ink jet apparatus.

44. A method for manufacturing an electron source having a plurality of electron emitting elements, in which an electron emitting element has a conductive film with an electron emitting portion between a pair of element electrodes, the method comprising the steps of:

forming a plurality of the pair of said element electrodes on a substrate;

detecting a state of arrangement of a structure on said substrate;

calculating positional information concerning each of a plurality of locations by comparing a designated value with a detected value of the pair of said element electrodes; and providing a liquid droplet material for said conductive film to a spacing of each of the pairs of said element electrodes based on the positional information by an ink jet apparatus, wherein said providing step is performed after said calculating step.

45. The method according to claim 44, wherein the structure is an element electrode.

46. A method for providing a material to a plurality of locations on a substrate comprising steps of:

obtaining an image of the substrate;

calculating positional information concerning each of the plurality of locations based on the image, said plurality of locations arranged in each of a plurality of directions; and providing the material to the plurality of locations based on the positional information, wherein said providing step is performed after said calculating step.

47. A method for providing a material to a plurality of locations on a substrate comprising steps of:

detecting a state of arrangement of a plurality of structures on the substrate;

calculating positional information concerning each of the plurality of locations based on the result of the detecting step, said plurality of locations arranged in each of a plurality of directions; and providing the material to the plurality of locations based on the positional information, wherein said providing step is performed after said calculating step.

48. The method according to claim 46, wherein said material is provided as a liquid.

49. The method according to claim 46, wherein said material is provided as a liquid droplet.

50. The method according to claim 46, wherein said material is provided by an ink jet apparatus.

51. The method according to claim 47, wherein said material is provided as a liquid.

52. The method according to claim 47, wherein said material is provided as a liquid droplet.

53. The method according to claim 47, wherein said material is provided by an ink jet apparatus.

* * * * *

UNITED STATES PATENT AND TRADEMARK OFFICE

CERTIFICATE OF CORRECTION

PATENT NO. : 6,579,139 B1
DATED : June 17, 2003
INVENTOR(S) : Seiji Mishima et al.

It is certified that error appears in the above-identified patent and that said Letters Patent is hereby corrected as shown below:

Title page,
Item [56], References Cited, FOREIGN PATENT DOCUMENTS,
"JP 7-95623 12/1990" should be deleted.

Column 2,
Line 38, "64-1332," should read -- 64-31332, --.

Column 3,
Line 1, "the" should read -- that the --.

Column 5,
Line 8, "corresponds" should read -- correspond --.

Column 9,
Line 37, "can" should read -- can be --.

Column 10,
Line 5, "$\mu$second" should read -- $\mu$ second --; and
Line 6, "$\mu$second" should read -- $\mu$ seconds --.

Column 12,
Line 8, "an" should be deleted.

Column 13,
Line 7, "fluopher" should read -- fluophor --.

Column 6,
Line 6, "is" should be deleted.

Column 7,
Line 33, "(not shown). elements." should read -- (not shown). --;

UNITED STATES PATENT AND TRADEMARK OFFICE

CERTIFICATE OF CORRECTION

PATENT NO. : 6,579,139 B1
DATED : June 17, 2003
INVENTOR(S) : Seiji Mishima et al.

It is certified that error appears in the above-identified patent and that said Letters Patent is hereby corrected as shown below:

Column 7 (cont'd),
Line 58, "conductive type on the electron" should read

--¶ In the image forming apparatus in this embodiment, a modulation signal for one line of an image is transmitted to rows of grid electrodes in synchronization with the one by one driving (scanning) of the element rows. As a result, the irradiation by the electron beams of the fluophors can be controlled, and an image can be displayed for each line.

The image forming apparatus provided by the manufacturing method of the present invention can be used as a display device for television programs, a display device for a television conference system or for a computer, and an optical printer that includes a photosensitive drum.

The features of the first embodiment are most exactly shown in Figs. 1 and 2, i.e., a liquid droplet providing device that correctly positions itself when depositing liquid droplets. Fig. 3 is an enlarged, schematic diagram showing the ejection head unit 6 in Figs. 1 and 2. An explanation will now be given for the arrangement of these devices and the method used for the fabrication of an electron source substrate that employs these devices.

In Fig. 1, the stage 15 includes an XY direction scanning mechanism (not shown) for moving the electron source substrate 81 in the directions X and Y. The electron source substrate 81 is mounted on the stage 15. The electron emitting elements of a surface conductive type on the electron source substrate 81 have the same arrangement as those in Fig. 8 (the X and the Y directional wirings are not shown). Each of the electron emitting elements, as well as the one shown in Figs. 9A and 9B, comprises the substrate 1, the element electrodes 2 and 3, and the thin conductive film 4. The CCD camera unit 7 is located at a position, above the electron source substrate 81, from which it can view the upper surface of the substrate 81. The ejection head unit 6 is provided for the application of liquid droplets.

In this embodiment, the ejection head unit 6 is fixed to a liquid droplet provision device. The electron source substrate 81 is moved to an arbitrary position by the stage 15, which includes the XY direction scanning mechanism, so that the ejection head unit 6 and the electron source substrate 81 are moved relative to it. The relationship between the position of the ejection head unit 6 (the ink jet head 8) and the position of the substrate 81 at which a liquid droplet 9 is ejected is measured before the liquid droplet 9 is applied between the element electrodes. An image obtained by the CCD camera unit 7 is transmitted to the image processing device 14, and is processed there. As a result, the optimal position at the center of gravity for depositing the liquid droplet 9 can be detected for individual electron emitting elements.--; and

UNITED STATES PATENT AND TRADEMARK OFFICE

CERTIFICATE OF CORRECTION

PATENT NO. : 6,579,139 B1
DATED : June 17, 2003
INVENTOR(S) : Seiji Mishima et al.

It is certified that error appears in the above-identified patent and that said Letters Patent is hereby corrected as shown below:

Column 7 (cont'd),
Lines 59-67 should be deleted.

Column 18,
Lines 1-37 should be deleted.

Column 22,
Line 1, "device" should read -- device 14 --; and
Line 9, "is" should be deleted.

Column 24,
Line 22, "A" should read -- An --.

Column 32,
Line 45, "1,." should read -- 1, --.

Column 33,
Lines 10 and 59, "including" should read -- including: --.

Signed and Sealed this

Thirty-first Day of August, 2004

JON W. DUDAS
*Director of the United States Patent and Trademark Office*